US010822892B2

(12) United States Patent
Migutin

(10) Patent No.: US 10,822,892 B2
(45) Date of Patent: Nov. 3, 2020

(54) WELLBORE TOOL COUPLING MECHANISM

(71) Applicant: Weatherford Technology Holdings, LLC, Houston, TX (US)

(72) Inventor: Alexander Migutin, Langenhagen (DE)

(73) Assignee: Weatherford Technology Holdings, LLC, Houston, TX (US)

( * ) Notice: Subject to any disclaimer, the term of this patent is extended or adjusted under 35 U.S.C. 154(b) by 367 days.

(21) Appl. No.: 15/843,844

(22) Filed: Dec. 15, 2017

(65) Prior Publication Data

US 2019/0186215 A1 Jun. 20, 2019

(51) Int. Cl.
*E21B 19/16* (2006.01)
*E21B 17/02* (2006.01)
*E21B 34/06* (2006.01)

(52) U.S. Cl.
CPC ..... *E21B 19/16* (2013.01); *E21B 17/028* (2013.01); *E21B 34/06* (2013.01)

(58) Field of Classification Search
CPC ..... E21B 19/165; E21B 19/164; E21B 19/16; E21B 19/20; E21B 19/168; E21B 19/24; E21B 19/00; E21B 19/161; E21B 19/163
See application file for complete search history.

(56) References Cited

U.S. PATENT DOCUMENTS 5,310,006 A * 5/1994 Freitas ..... E21B 33/0355 166/339
2006/0090898 A1* 5/2006 Tyrrell ..... E21B 33/0355 166/313
2008/0073904 A1* 3/2008 Changalpet ..... F16L 1/26 285/26
2011/0266003 A1* 11/2011 Singh ..... E21B 33/064 166/368
2012/0168168 A1* 7/2012 Cruden ..... E21B 33/038 166/338
2014/0112699 A1* 4/2014 Lewkoski ..... F16B 17/00 403/33
2015/0252635 A1 9/2015 Hartley et al.
2018/0073312 A1* 3/2018 Clostio, Jr. ..... E21B 19/24

OTHER PUBLICATIONS

PCT International Search Report and Written Opinion dated Mar. 20, 2019, for International Application No. PCT/US2018/065532.

* cited by examiner

*Primary Examiner* — Kipp C Wallace
(74) *Attorney, Agent, or Firm* — Patterson + Sheridan, LLP

(57) ABSTRACT

A coupling mechanism for coupling a first downhole tool to a second downhole tool includes a first portion, a second portion, and a locking device for locking the first portion to the second portion. The first portion includes a frame; a plug body movable relative to the frame; a guiding element coupled to the plug body; at least one of a hydraulic plug and an electric plug; and an actuator for moving the plug body relative to the frame. The second portion includes a receptacle body; a guide receptacle for receiving the guiding element; a respective receptacle for receiving at least one of the hydraulic plug; and the electric plug.

20 Claims, 27 Drawing Sheets

WELLBORE TOOL COUPLING MECHANISM

BACKGROUND OF THE DISCLOSURE

Field of the Disclosure

The present disclosure generally relates to a wellbore tool coupling mechanism. Particularly, embodiments of the present disclosure relate to a coupling mechanism for coupling a tong to a positioning tool.

Description of the Related Art

In oil and gas operation, wellbore tools, such as a tong, may be transferred and positioned to various locations. A positioning tool is usually used to move the wellbore tools. During a well operation, a work string, such as a drill string and a casing string, is deployed a wellbore. The work string may be made from multiple lengths of tubulars. Typically, a tong is used to connect tubulars to form the work string. The tong rotates a tubular to add the tubular to the top of the work string by a threaded connection. The tong provides the torque necessary to make-up (or break-out) the connection. At various times during the operation, the tong is moved between several locations at the well site, such as at well centerline, mouse holes, or a storage position.

In some instances, the positioning tool connects to the tong provide power or data communication. For example, communication with the power tong can include hydraulic and/or electric communication. Typically, connection of the positioning tool to the power tong is done manually. The connection process may be strenuous due the relative stiff and heavy hoses used. Also, the connection process may be performed in a machine operating area or in an explosive hazardous zone, which increases the safety risk to the operator.

Therefore, there is a need for an automatic wellbore tool coupling mechanism.

SUMMARY OF THE DISCLOSURE

In one embodiment, a coupling mechanism for coupling a first downhole tool to a second downhole tool includes a first portion, a second portion, and a locking device for locking the first portion to the second portion. The first portion includes a frame; a plug body movable relative to the frame; a guiding element coupled to the plug body; at least one of a hydraulic plug and an electric plug; and an actuator for moving the plug body relative to the frame. The second portion includes a receptacle body; a guide receptacle for receiving the guiding element; a respective receptacle for receiving at least one of the hydraulic plug; and the electric plug.

In another embodiment, a method of coupling a first downhole tool to a second downhole tool includes extending a plug body of the first downhole tool toward a receptacle body of the second downhole tool; connecting a guiding element to a guide receptacle; connecting an electric plug to an electric receptacle; and actuating a locking device to lock the plug body to the receptacle.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Embodiments of the present disclosure generally relate to apparatus and methods for handling wellbore tools. More particularly, embodiments of the present disclosure generally relate to a coupling mechanism configured to automatically connect wellbore tool such as a tong to a positioning tool. The coupling mechanism may provide hydraulic and electric communication between the tong and the positioning tool. To better understand the aspects of the present disclosure and the methods of use thereof, reference is hereafter made to the accompanying drawings.

Figure 1A:
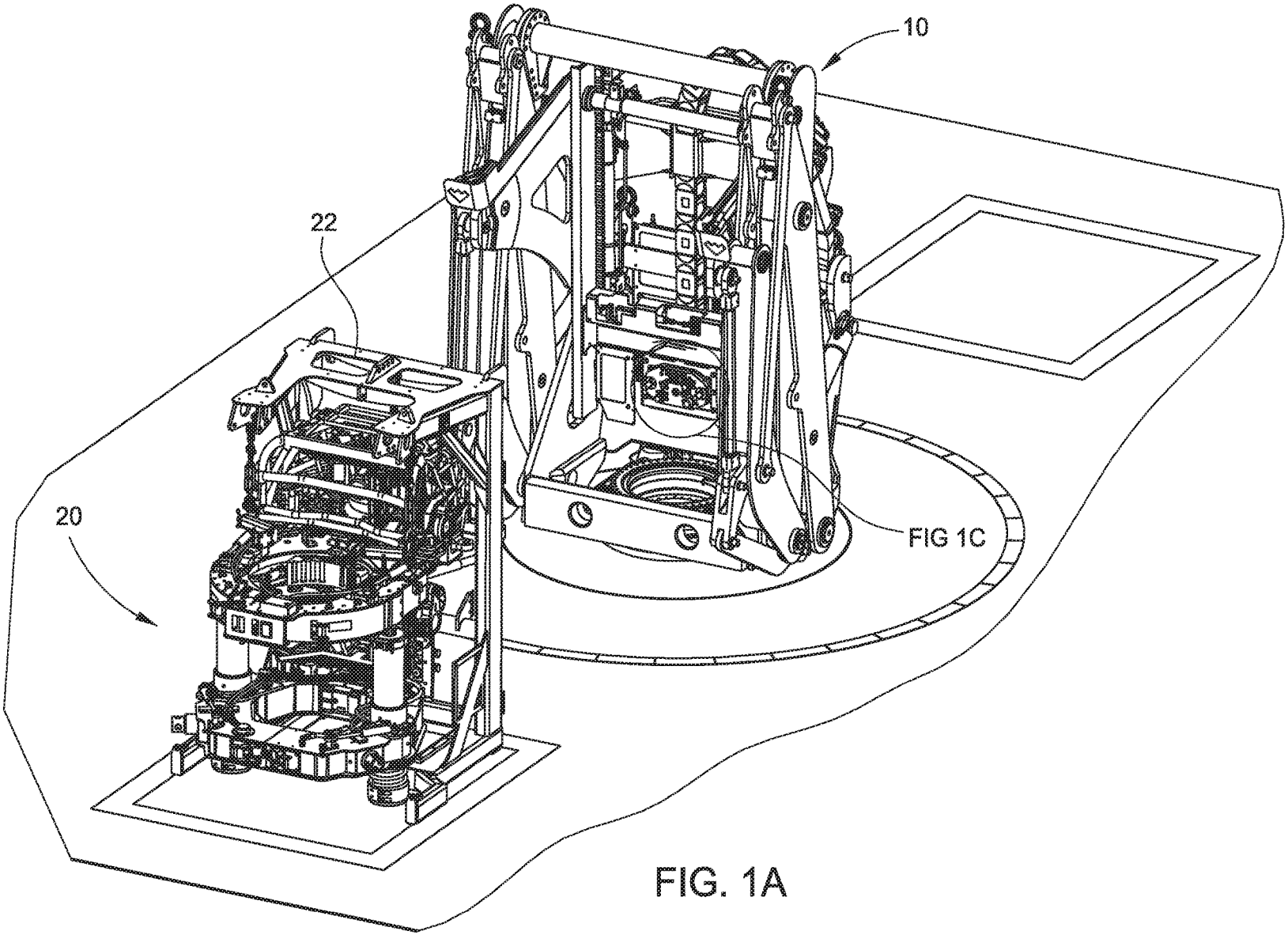
FIGS. 1A and 1B illustrate an exemplary positioning tool located proximate to an exemplary wellbore tool such as a tong.
Figure 1B:
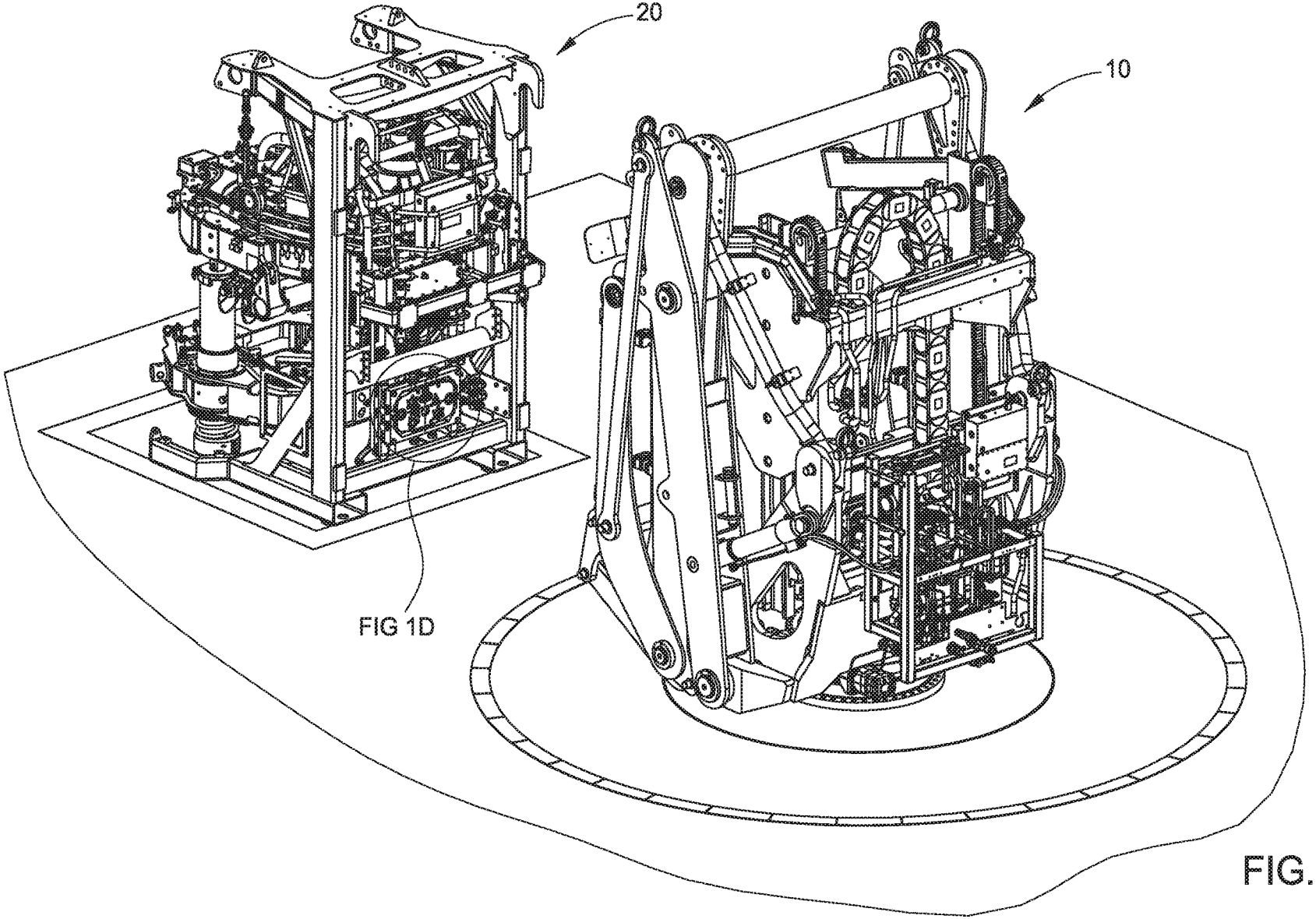
Figure 1C:
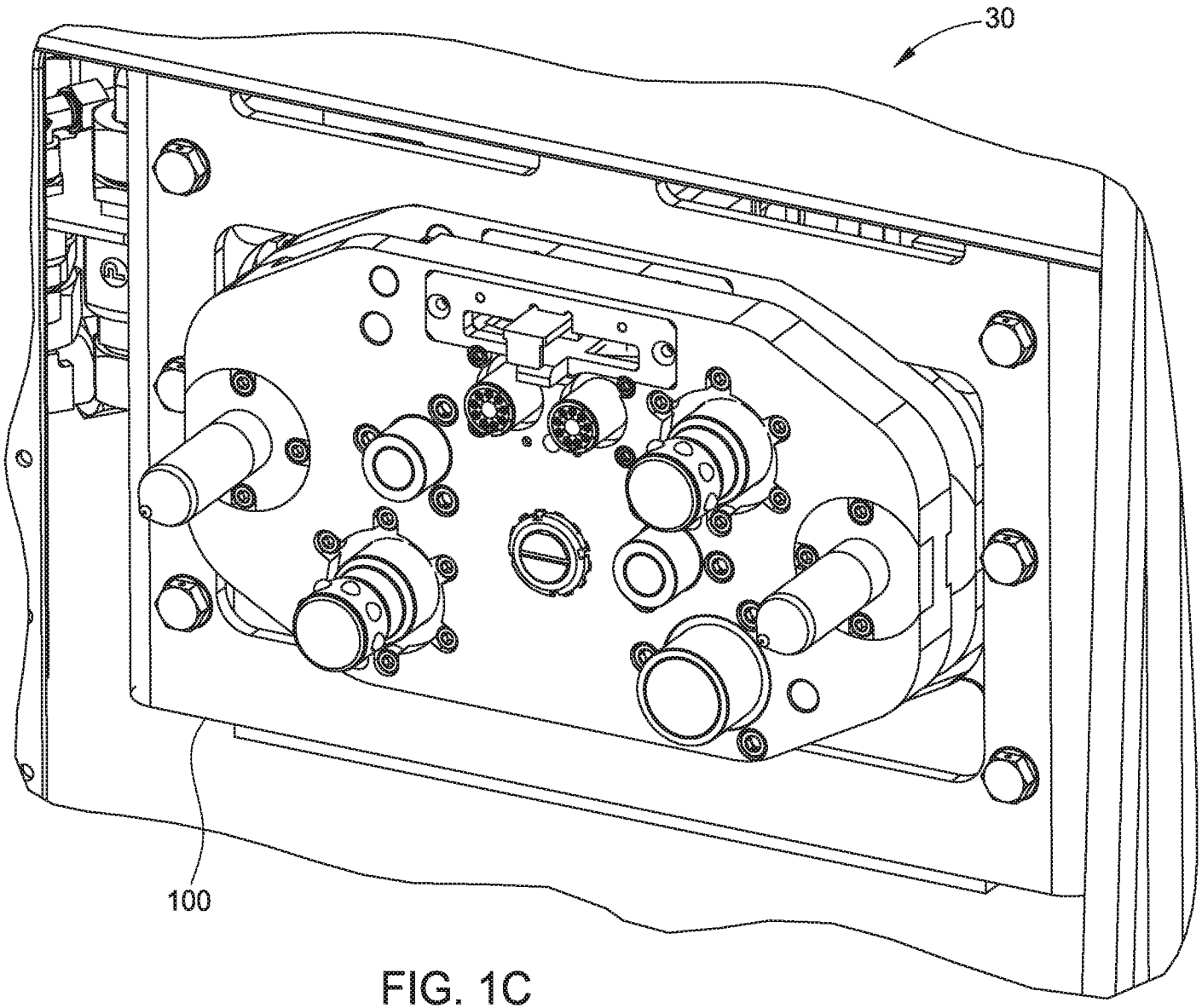
FIG. 1C is an enlarged partial view of FIG. 1A.
Figure 1D:
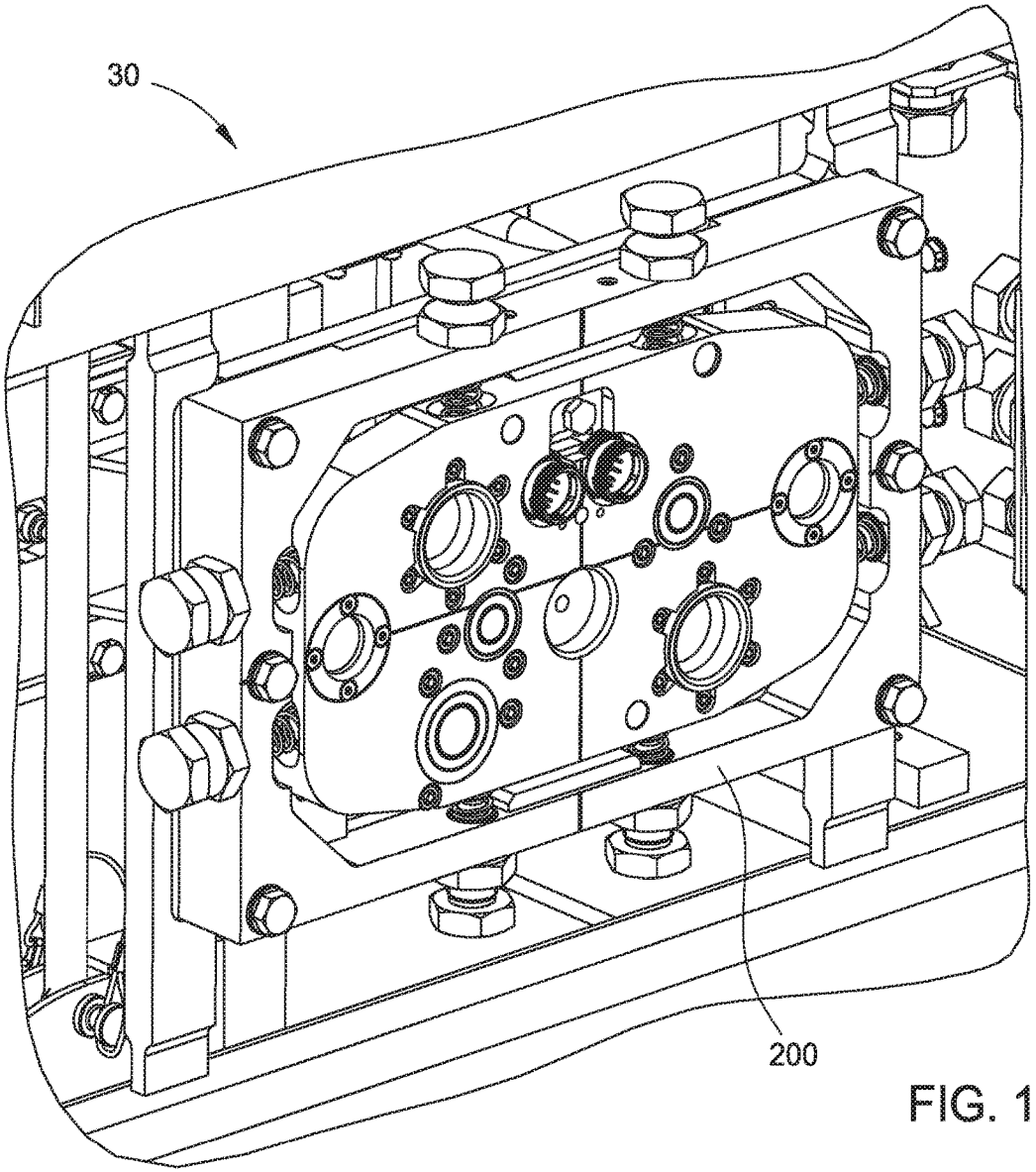
FIG. 1D is an enlarged partial view of FIG. 1B.

FIGS. 1A and 1B illustrate an exemplary positioning tool 10 located proximate to an exemplary wellbore tool such as a tong 20. FIG. 1A shows the front side of the positioning tool 10. FIG. 1C is an enlarged partial view of FIG. 1A. An exemplary positioning tool is disclosed in U.S. patent application Ser. No. 15/667,504, filed on Aug. 2, 2017, which is incorporated herein by reference; in particular, FIGS. 1A-1D and the associated description in the specification. FIG. 1B shows the back side of the tong 20. FIG. 1D is an enlarged partial view of FIG. 1B.

An exemplary coupling mechanism 30 for coupling the positioning tool 10 to the tong 20 is shown in FIGS. 1A-1D, according to embodiments disclosed herein. The coupling mechanism 30 includes a first portion 100 engageable with a second portion 200. As shown in FIGS. 1A and 1C, the first portion 100 is disposed on the positioning tool 10. As shown in FIGS. 1B and 1D, the second portion 200 is disposed on the tong 20. In this example, the second portion 200 is attached to a support structure 22 supporting the tong 20. The first portion 100 and the second portion 200 are arranged on the positioning tool 10 and the tong 20, respectively, in a manner that, when the positioning tool 10 engages the tong 20, the first portion 100 is aligned with the second portion 200 for connection therewith.

Figure 2A:
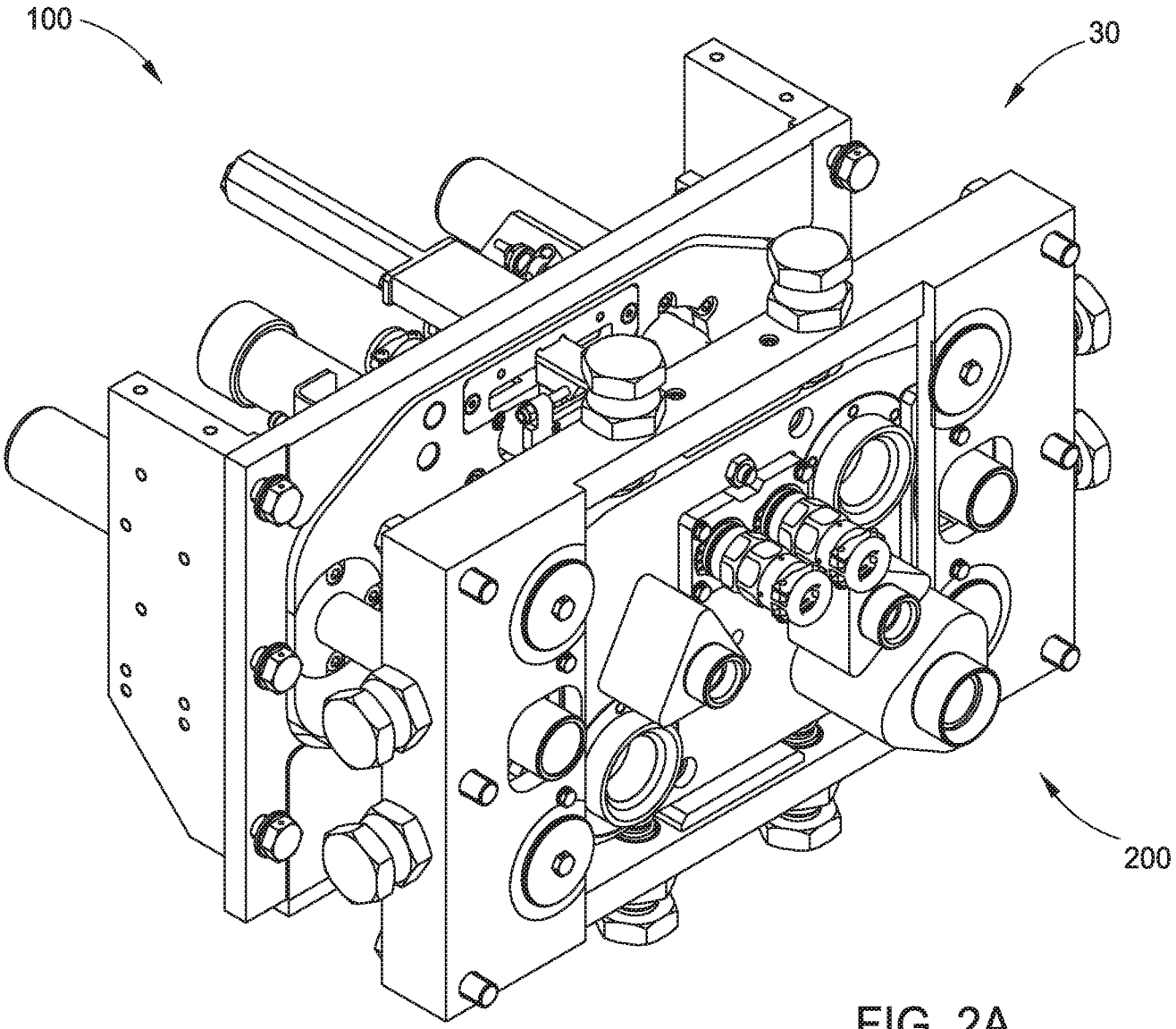
FIGS. 2A and 2B illustrate different perspective views of an embodiment of a coupling mechanism.
Figure 2B:
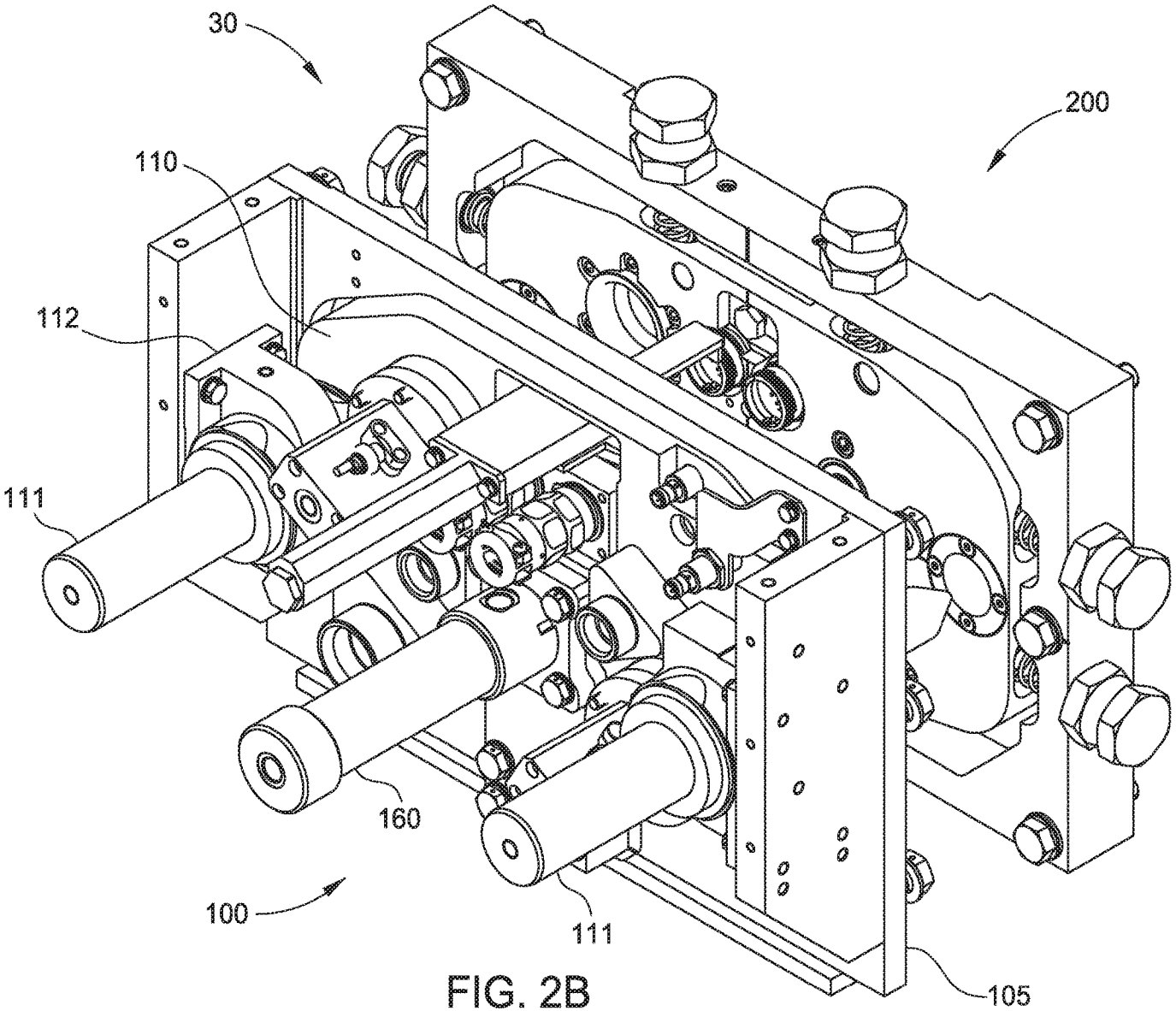

FIGS. 2A and 2B illustrate different perspective views of the coupling mechanism 30. These Figures show the first and second portions 100, 200 of the coupling mechanism 30 just before engagement. FIG. 2A shows a perspective from the back side of the second portion 200, and FIG. 2B shows a perspective from the back side of the first portion 100.

Figure 3A:
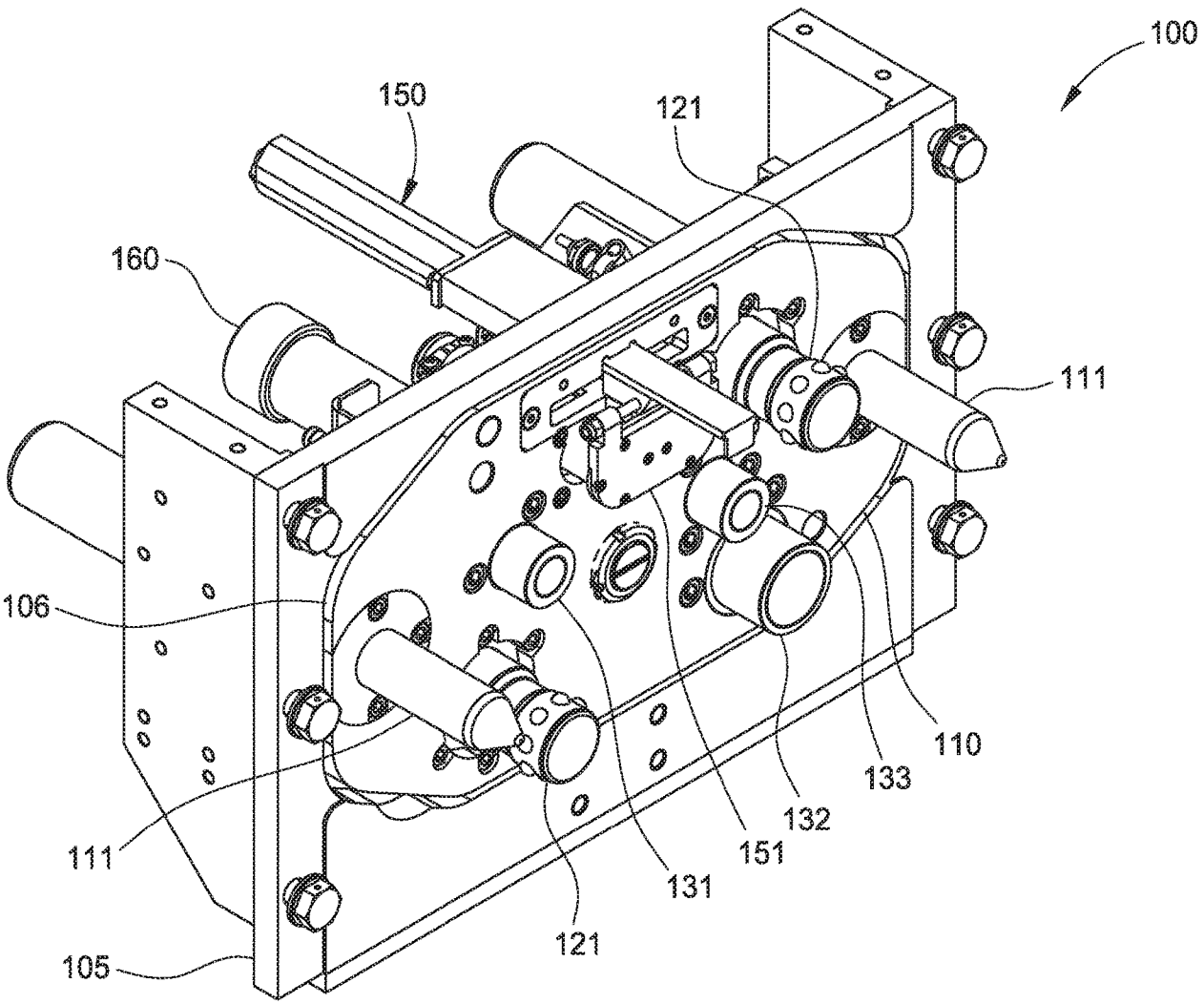
FIGS. 3A, 3B, and 3C illustrate different perspective views of the first portion of the coupling mechanism.
Figure 3B:
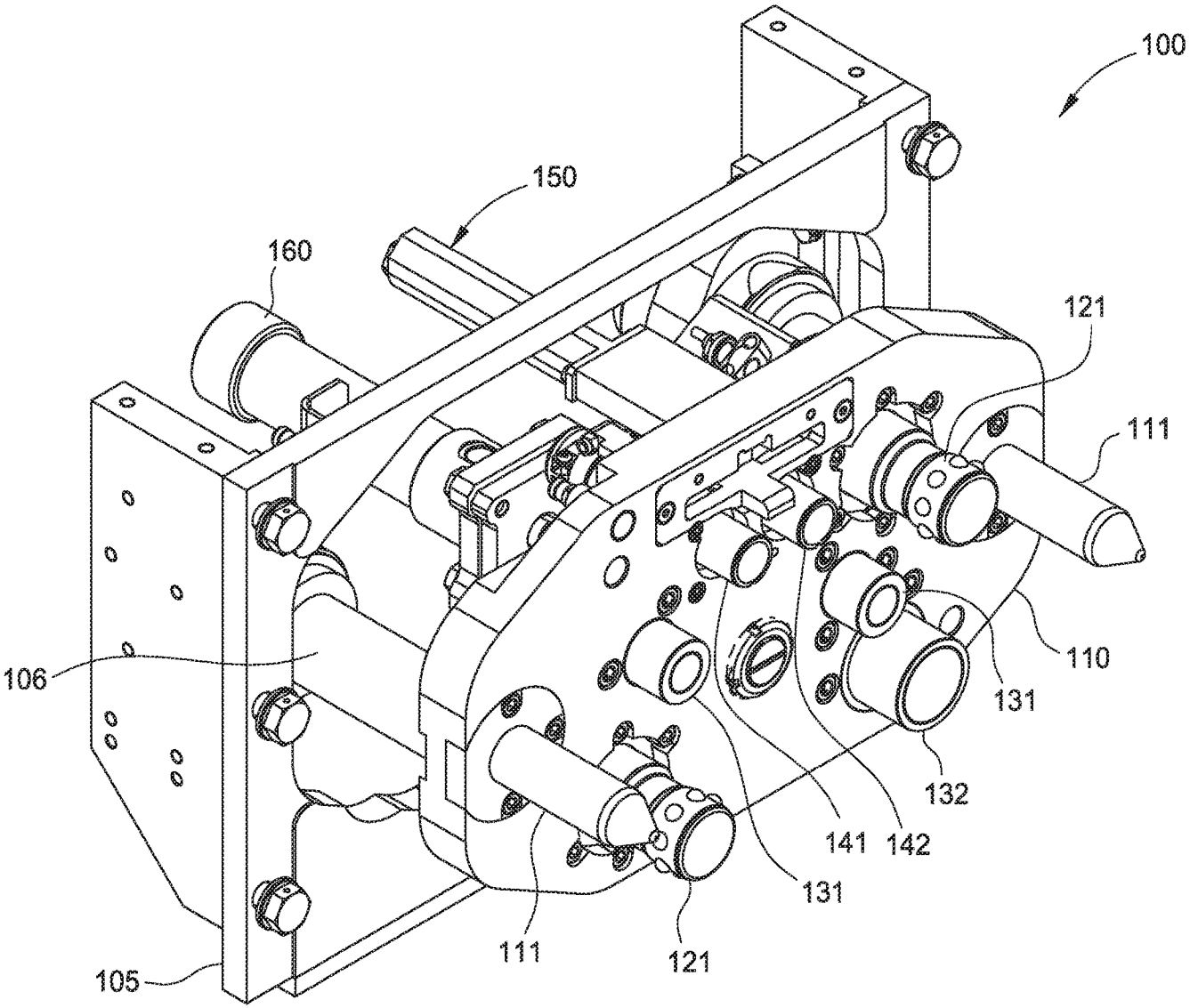
Figure 3C:
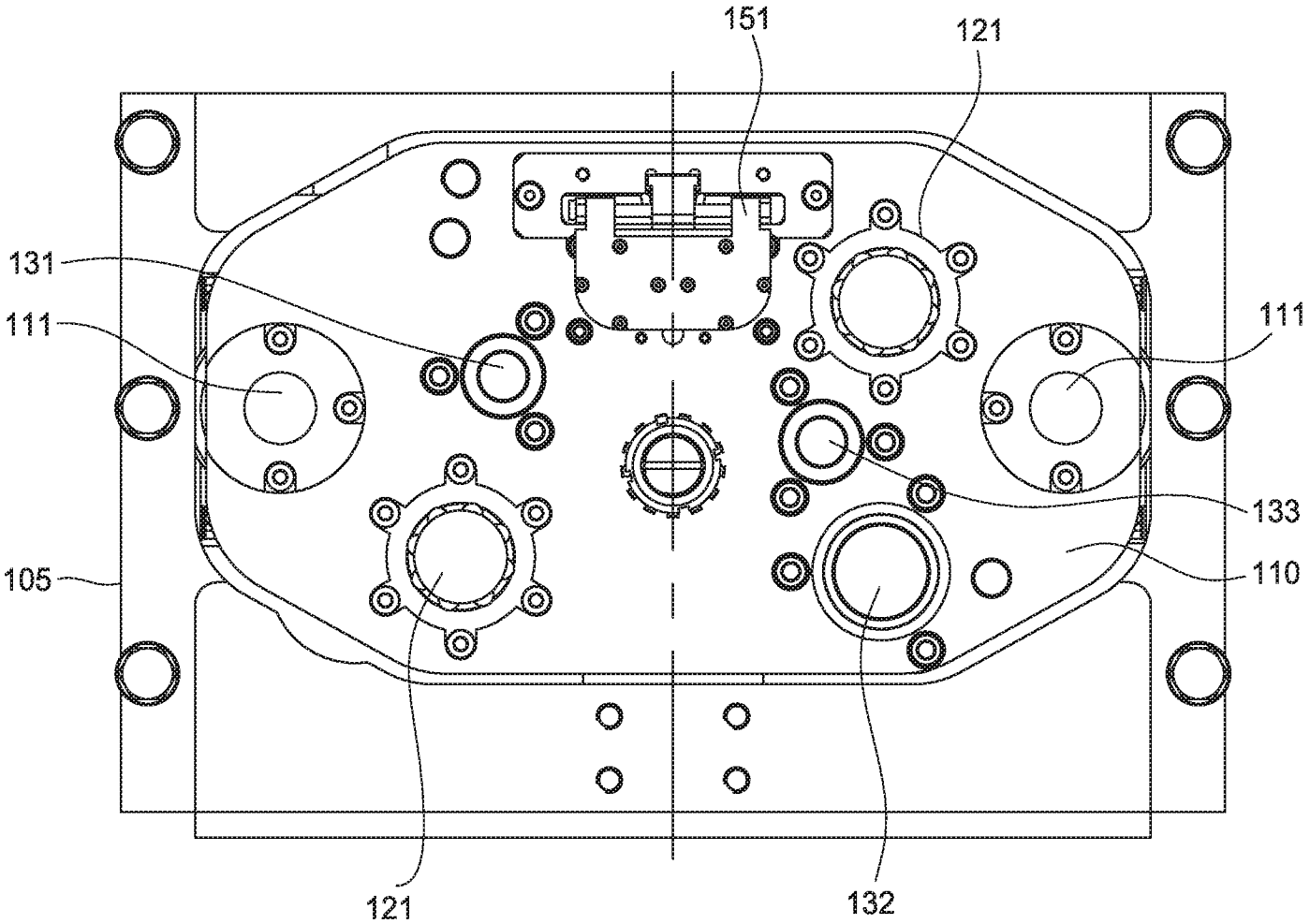

FIGS. 3A, 3B, and 3C illustrate different perspective views of the first portion 100 of the coupling mechanism 30. The first portion 100 includes a frame 105 for attachment to the positioning tool 10. A plug body 110 is disposed in a window 106 of the frame 105 and movably coupled to the frame 105. FIG. 3A shows the plug body 110 disposed in the window 106, before engagement with the second portion 200. In one embodiment, the plug body 110 is a plate. FIG. 3B shows the plug body 110 extended out of the window 106, after engagement with the second portion 200. FIG. 3C shows the front view of the first portion 100.

Figure 3D:
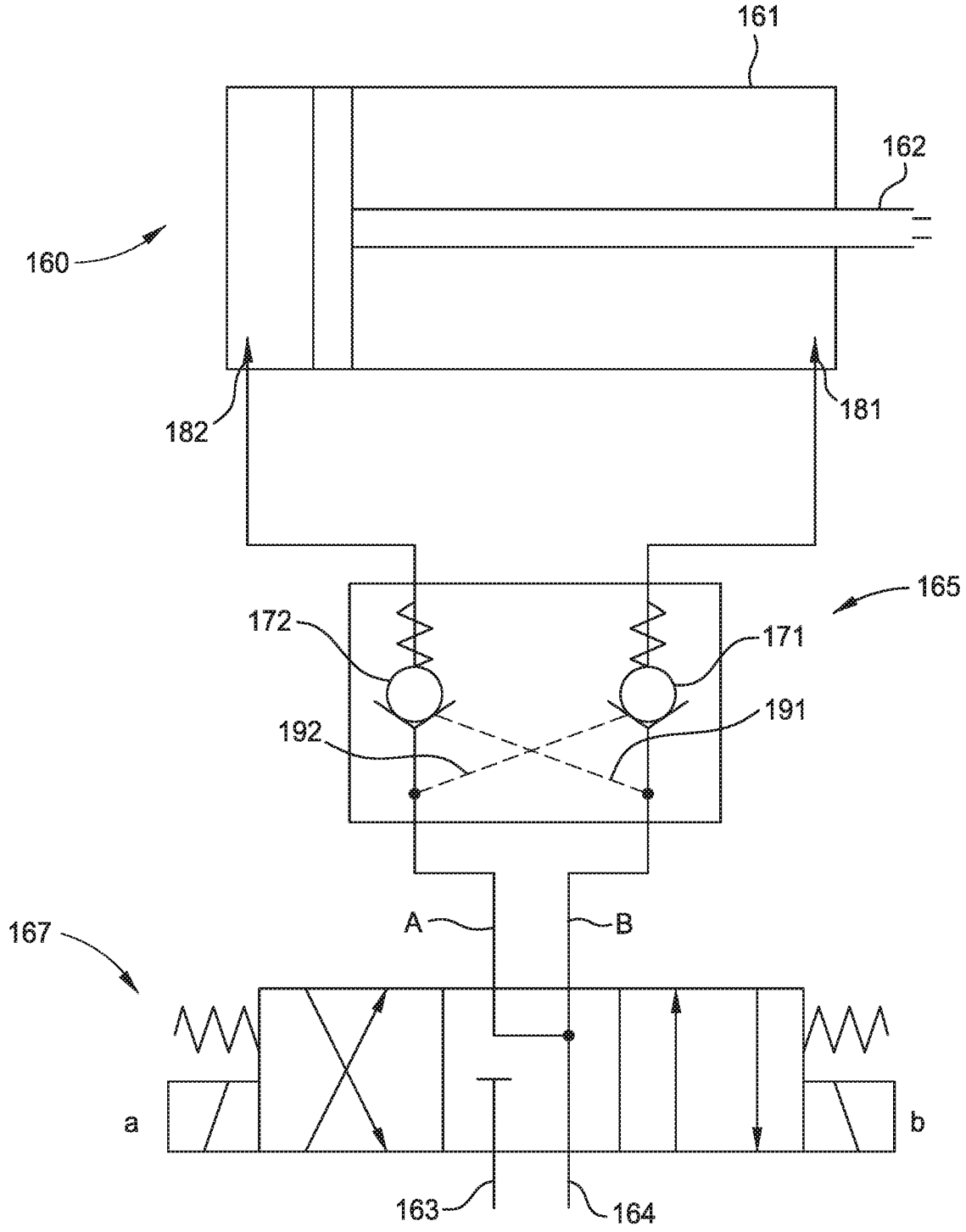
FIGS. 3D-3F are schematic illustrations of an exemplary operation of a check valve assembly.
Figure 3E:
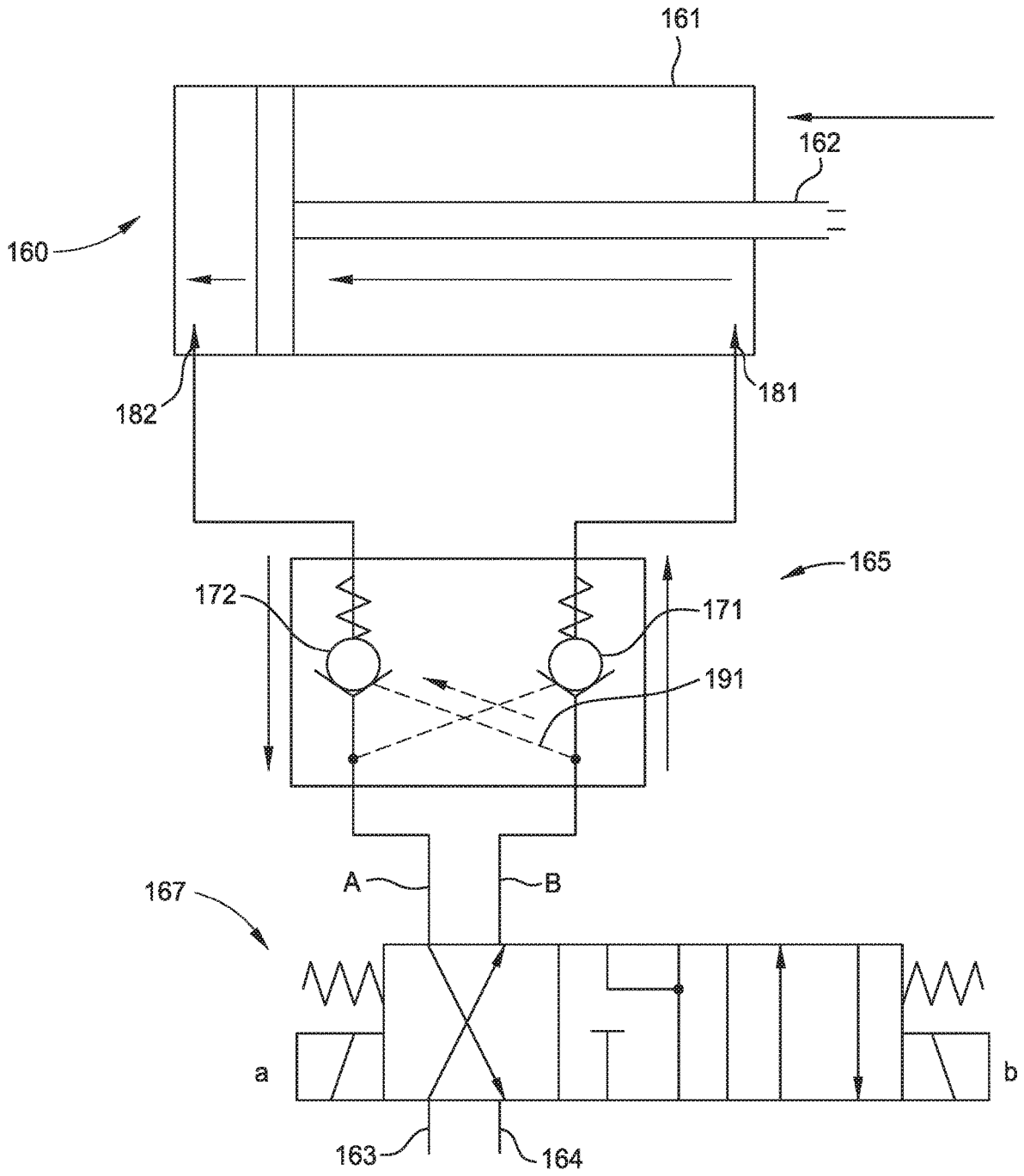
Figure 3F:
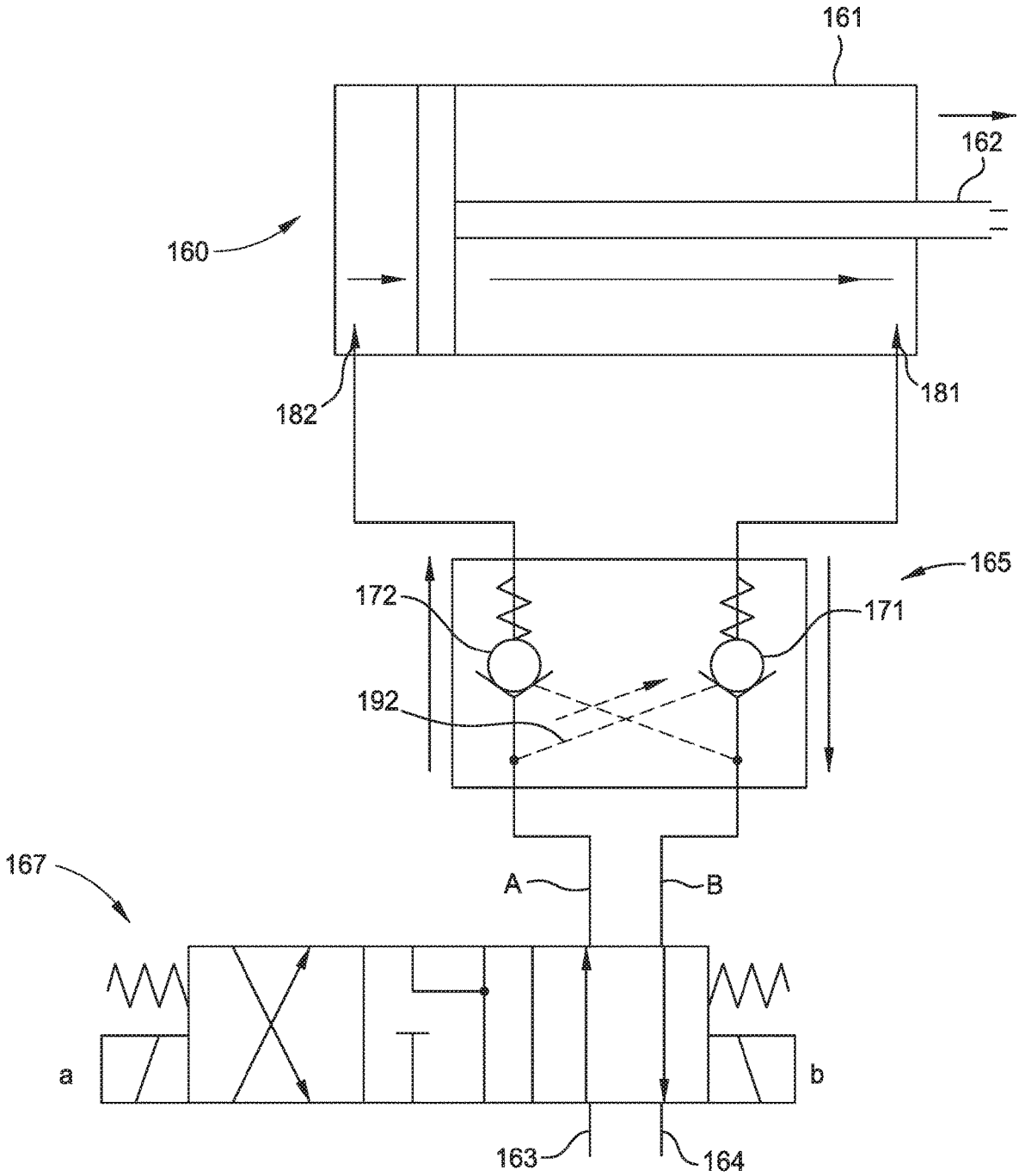

In one embodiment, a hydraulic cylinder 160 is used to move the plug body 110 relative to the window 106 and the frame 105. The housing of the cylinder 160 is attached to the frame 105 and piston of the cylinder 160 is attached to the plug body 110. In one embodiment, a check valve assembly is used to actuate the hydraulic cylinder 160. FIGS. 3D-3F are schematic illustrations of an exemplary operation of the check valve assembly 165. FIG. 3D shows a double pilot controlled check valve assembly 165 for actuating the hydraulic cylinder 160. The valve controller 167 of the valve assembly 165 is shown in the center position in which line A and line B are both in communication with the fluid outlet 164. Each of the lines A and B includes a one way pilot valve 171, 172 that allows fluid to be supplied to toward the cylinder 160. In this example, the first pilot valve 171 controls fluid communication of line B to the cylinder port 181 for retracting the piston 162, and the second pilot valve 172 controls fluid communication of line B to the cylinder port 182 for extending the piston 162. A first pilot line 191 in communication with line A directs fluid in line A to the second pilot valve 172 to open the second pilot valve 172 to relieve fluid from the second cylinder port 182. A second pilot line 192 in communication with line B directs fluid in line B to the first pilot valve 171 to open the first pilot valve 171 to relieve fluid from the first cylinder port 181.

To extend the piston 162, the valve controller 167 is moved to the left so that line A is in communication with the inlet 163 and line B is in communication with the outlet 164, as shown in FIG. 3E. In this respect, pressurized fluid can supplied to line A, through the second pilot valve 172, and to the second cylinder port 182, thereby extending the piston 162 outward relative to the housing 161. Some of the fluid in line A is directed toward the first pilot valve 171 via the second pilot line 192 to open the first pilot valve 171 so that fluid from the first cylinder port 181 can be relieved via the fluid outlet 164.

To retract the piston 162, the valve controller 167 is moved to the right so that line A is in communication with the outlet 164 and line B is in communication with the inlet 163, as shown in FIG. 3F. In this respect, pressurized fluid can be supplied to line B, through the first pilot valve 172, and to the first cylinder port 181, thereby retracting the piston 162 relative to the housing 161. Some of the fluid in line B is directed toward the second pilot valve 172 via the first pilot line 191 to open the second pilot valve 172 so that fluid from the second cylinder port 182 can be relieved via the fluid outlet 164.

Figure 4A:
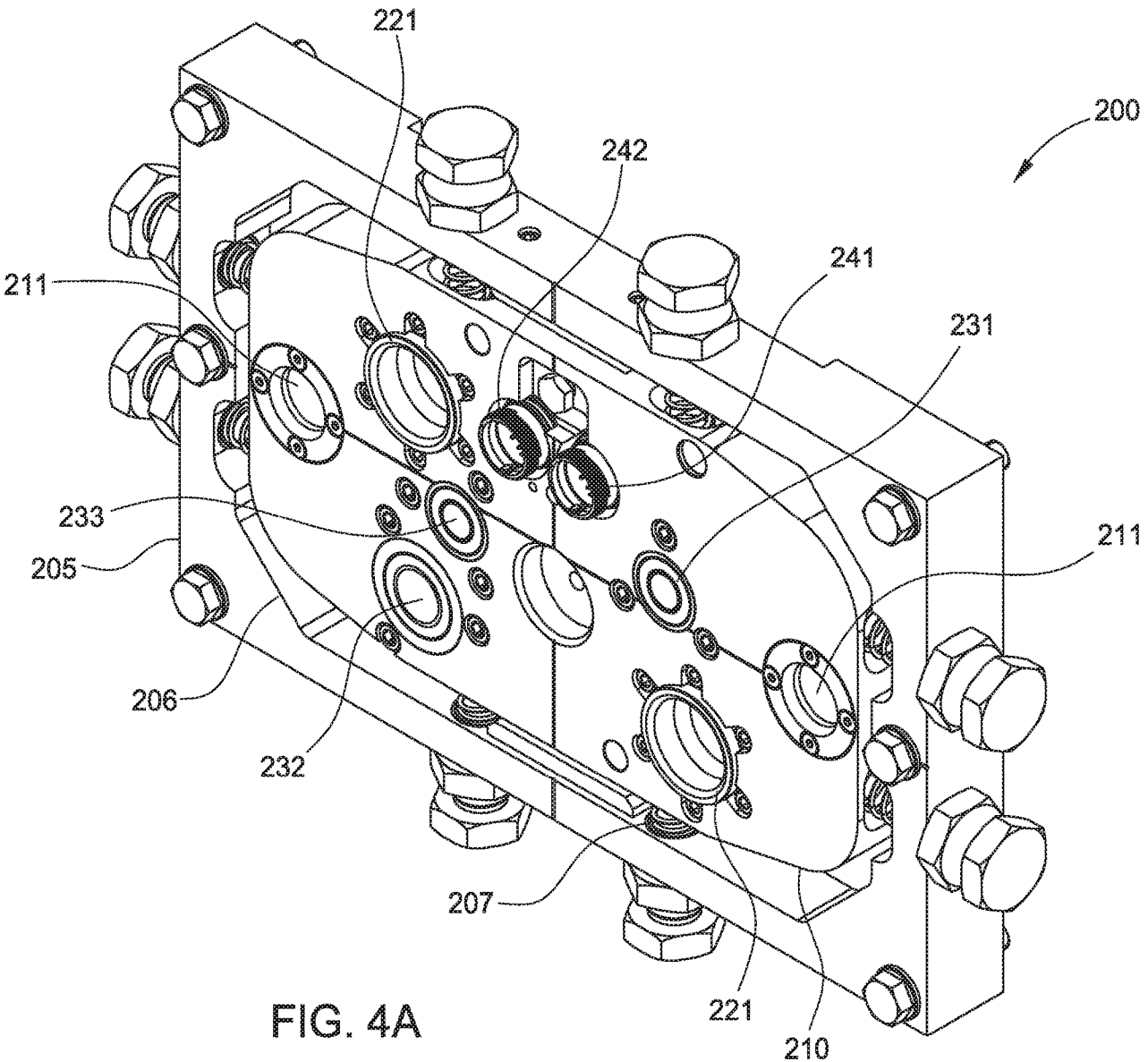
FIGS. 4A and 4B illustrate different perspective views of the second portion of the coupling mechanism.
Figure 4B:
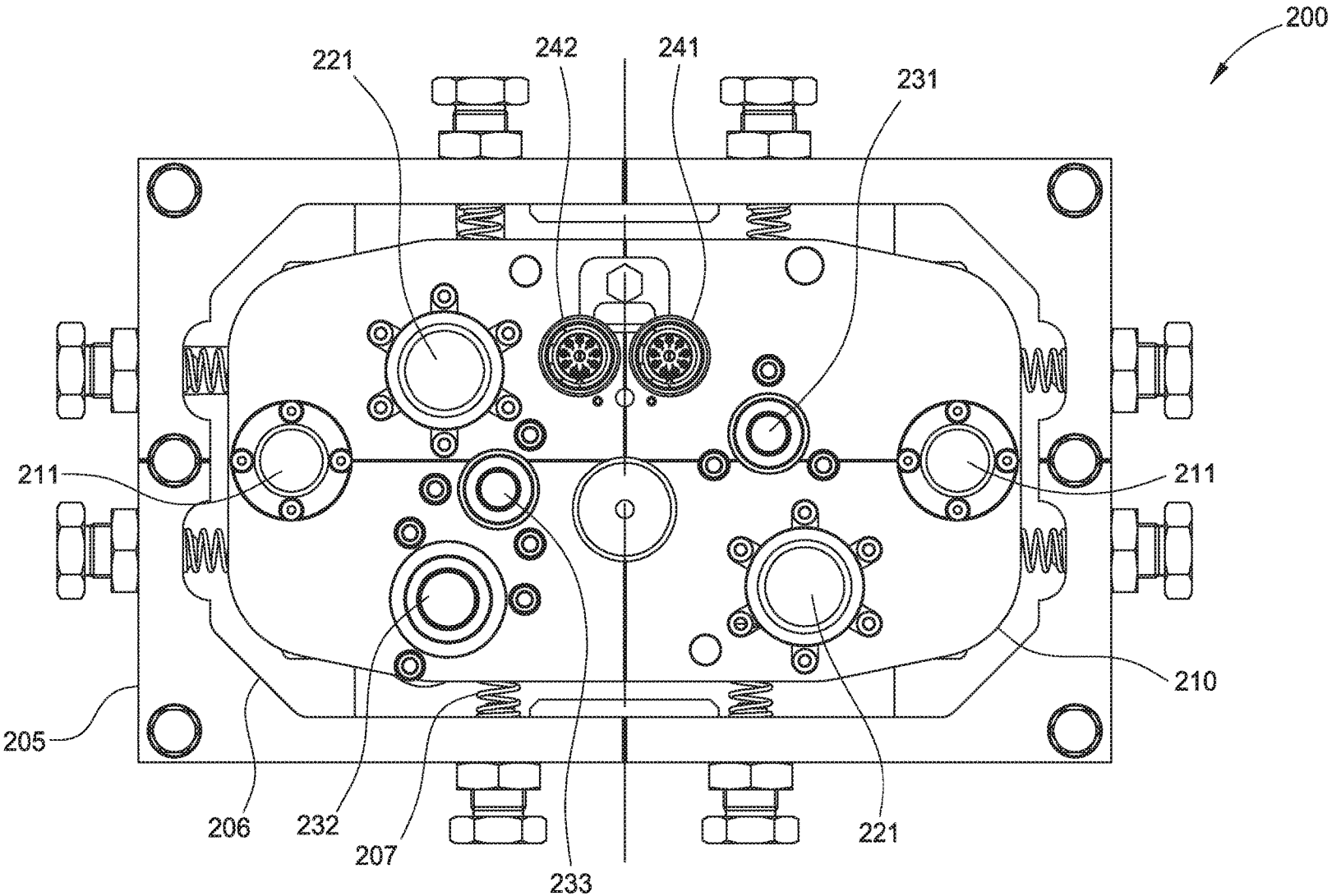

FIGS. 4A and 4B illustrate different views of the second portion 200 of the coupling mechanism 30. The second portion 200 includes a frame 205 for attachment to the tong 20. A receptacle body 210 is disposed in a window 206 of the frame 205. FIG. 4A shows the receptacle body 210 disposed in the window 206. In one embodiment, the receptacle body 210 is a plate. FIG. 4B shows the front view of the second portion 200. The receptacle body 210 may be coupled to the frame 205 using a plurality of springs 207. The springs 207 are disposed in a hole formed in a side surface of the receptacle body 210. As shown, a plurality of springs 207 is disposed around the perimeter of the receptacle body 210.

In one embodiment, one or more guiding elements 111 are used to align the plug body 110 to the receptacle body 210. The guiding element 111 is coupled to a holder 112 attached to the frame 105. The guiding element 111 is also attached to the plug body 210 and movable therewith. In one example, the guiding element 111 is an elongated member. The guiding element 111 can extend or retract relative to the holder 112 as the plug body 110 is moved relative to the frame 105 by the hydraulic cylinder 160. A section of the guiding element 111 extends out of the plug body 110 for engagement with the second portion 200. The front end of the guiding element 111 may have a pointed tip to facilitate engagement with a receiving hole 211 in the receptacle body 210 of the second portion 200. While two guiding elements 111 are shown, any suitable number of guiding elements 111 may be used, such as one, three, four, five, or more.

The coupling mechanism 30 includes a plurality of hydraulic couplings for fluid communication between the positioning tool 10 and the tong 20. In one embodiment, a plurality of hydraulic plugs 131, 132, 133 attached to the plug body 110 are configured to engage with the hydraulic receptacles 231, 232, 233 in the receptacle body 210. In one example, hydraulic couplings include a plug 231 for supplying hydraulic fluid, a plug 232 for returning the hydraulic fluid, and a plug 233 for draining the hydraulic fluid. Additional plugs may be provided as necessary. Any suitable hydraulic couplings may be used. It must be noted that, while not shown, hydraulic lines are used for communication between the coupling mechanism 30, positioning tool 10, tong 20, and other fluid sources, if any.

The coupling mechanism 30 includes a plurality of electrical couplings for electrical power and data communication between the positioning tool 10 and the tong 20. In one embodiment, a plurality of electrical plugs 141, 142 attached to the plug body 110 are configured to engage with the electrical receptacles 241, 242 in the receptacle body 210. In one example, electrical couplings include a plug 241 for supplying electrical power, and a plug 242 for data communication. Data communication may include I/O signals or via the Ethernet. Any suitable electrical couplings may be used for power and data communication. In one example, an electrical connector suitable for use with a power tong 20 and positioning tool 10 is hazardous area connector that is commercially available from Hawke International, which has the website www.ehawke.com. For example, a suitable hazardous area connector is an InstrumEx connector available from Hawke International. It must be noted that, while not shown, electric lines are used for communication between the coupling mechanism 30, positioning tool 10, tong 20, and other power or data sources such as a battery, a generator, or a controller, if any. In one example, the hazardous area is an explosive atmosphere, such as zone 1 area of ATEX or IECEx.

Figure 5A:
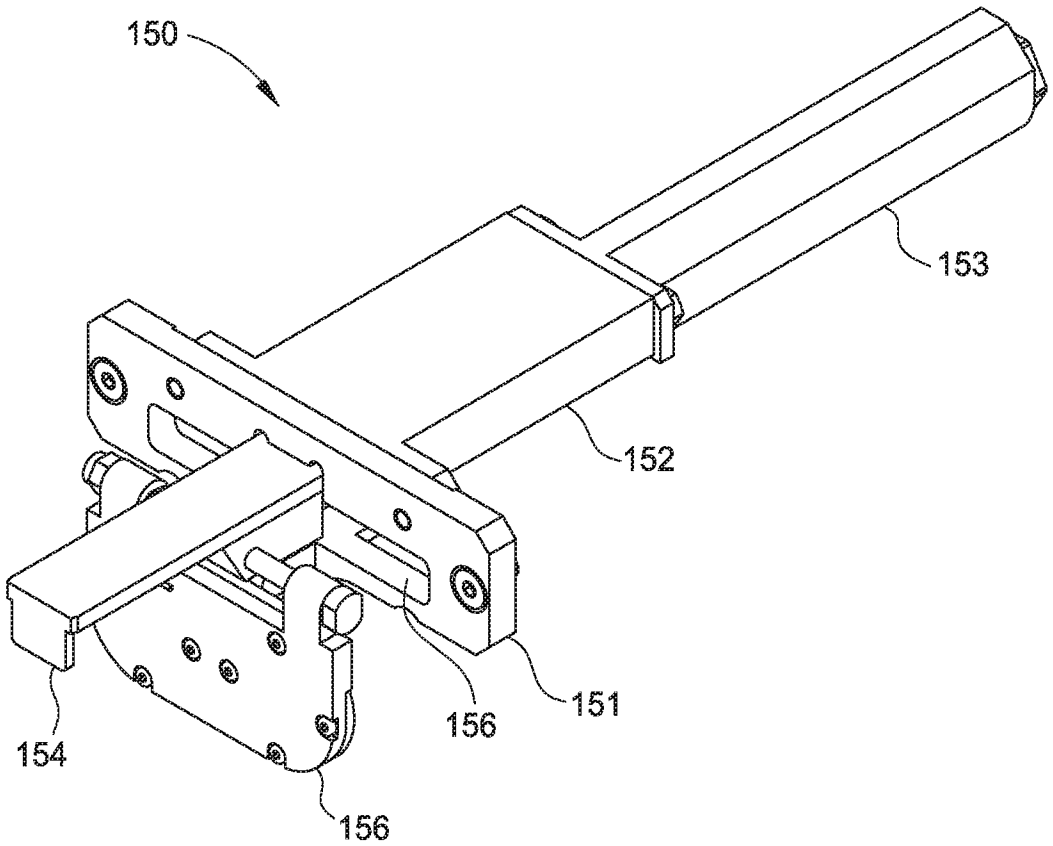
FIGS. 5A-5D illustrate an exemplary embodiment of a protection tool.
Figure 5B:
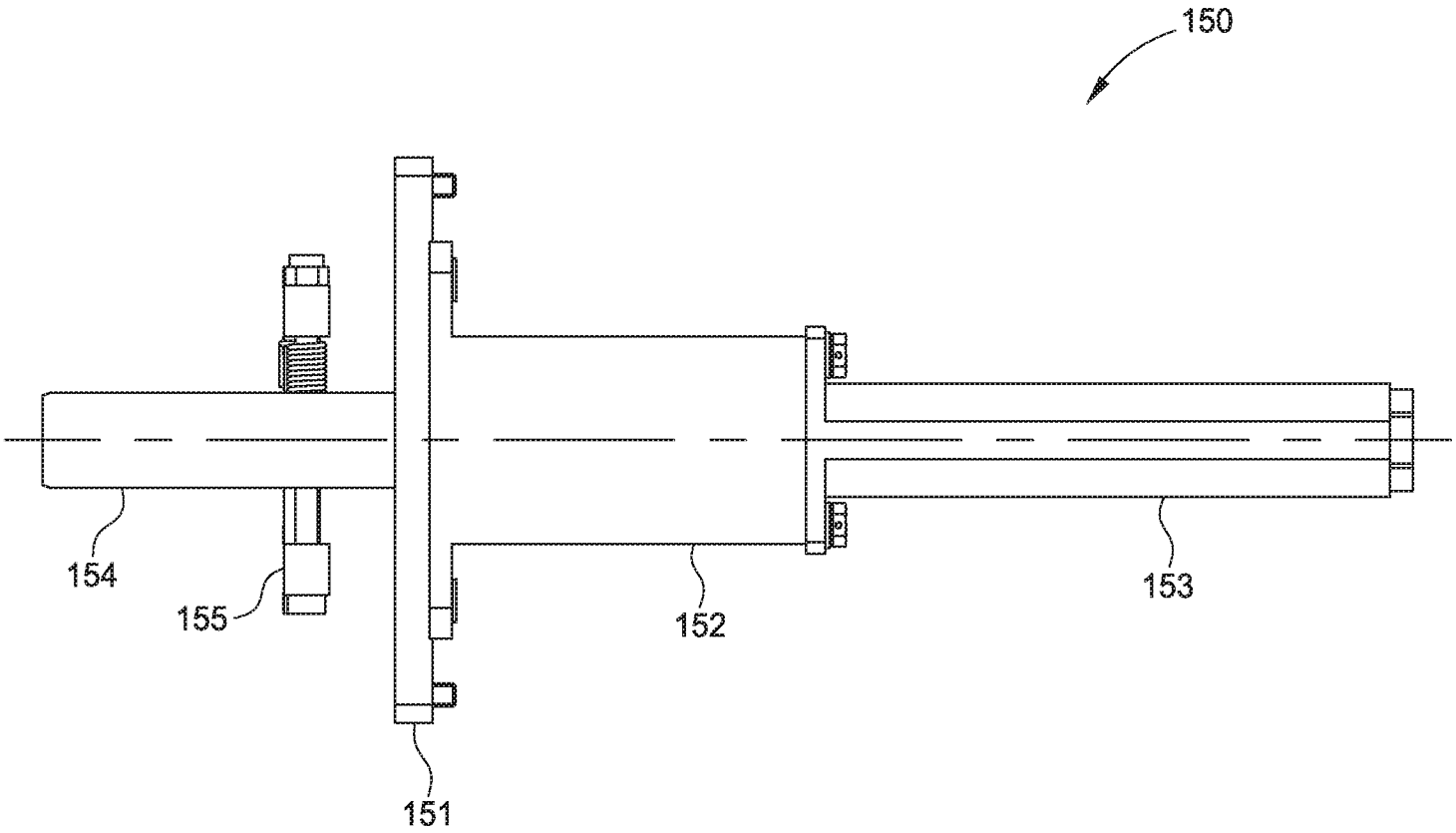
Figure 5C:
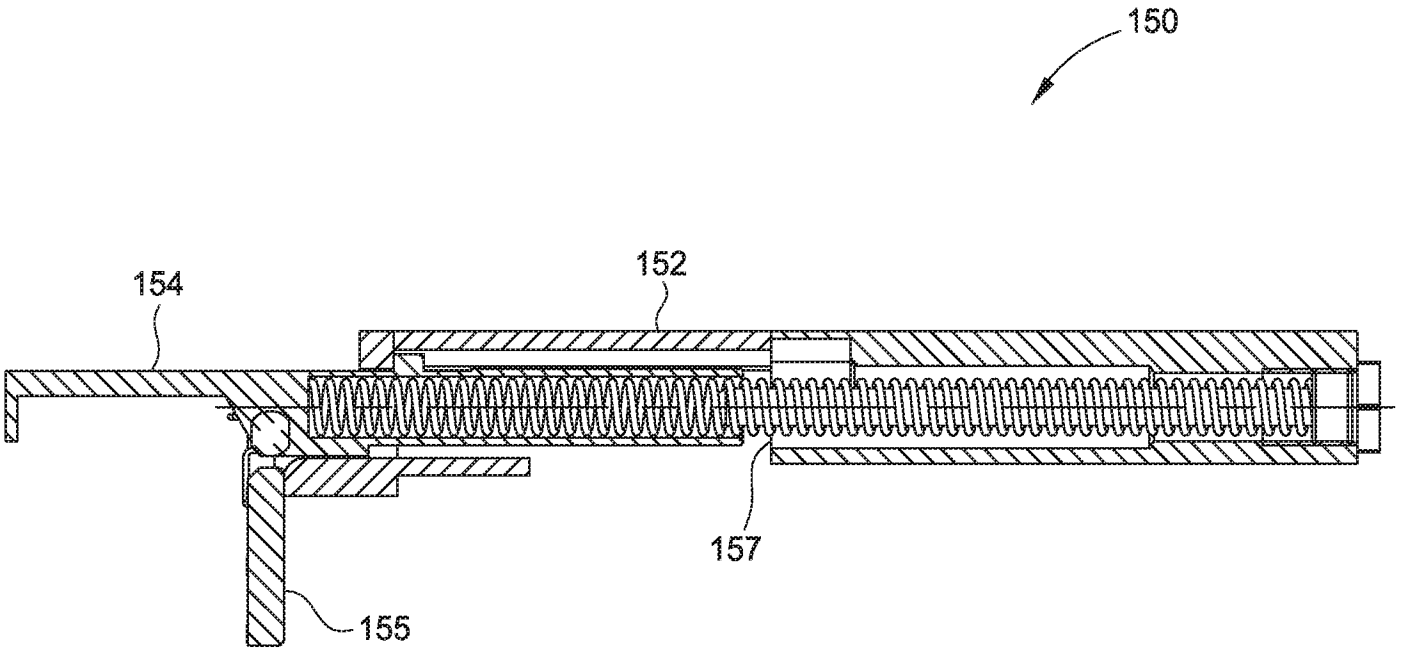
Figure 5D:
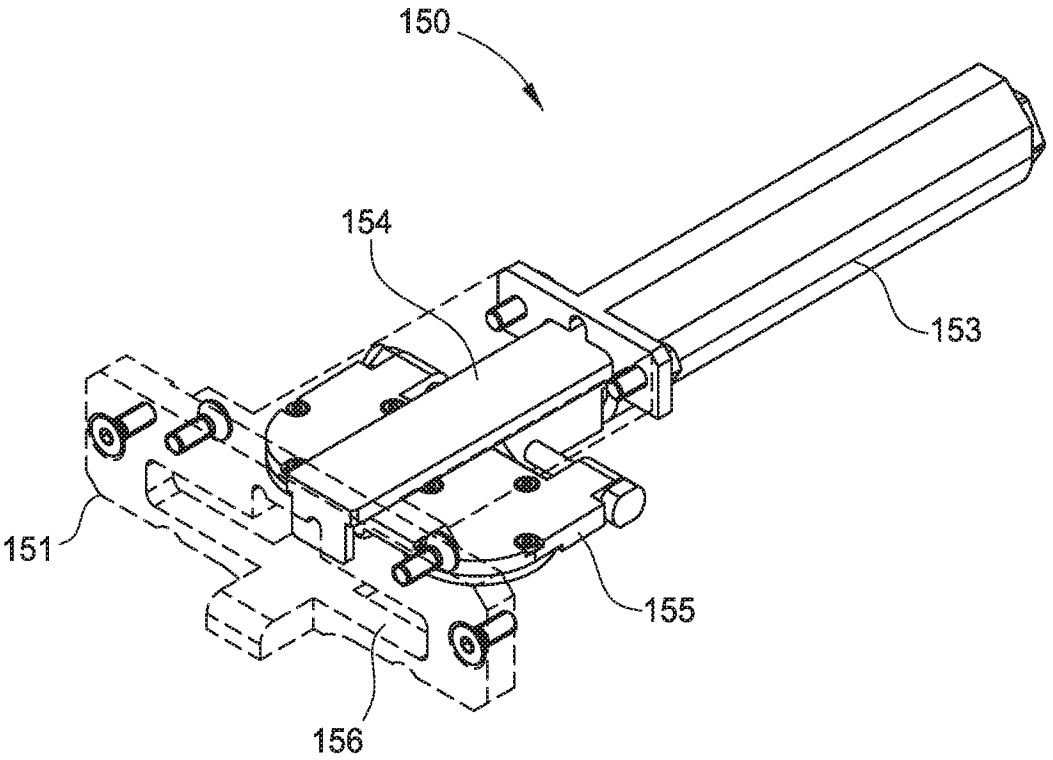

In one embodiment, the electrical plugs 141, 142 may be covered using an optional protection tool 150. FIGS. 5A-5D illustrate an exemplary embodiment of a protection tool 150. The protection tool 150 includes a mounting plate 151 for attachment to the frame 110, a guide housing 152, a spring housing 153, a guide post 154, and a cover plate 155. The guide housing 152 is attached to the mounting plate 151, and the spring housing 153 is attached to the guide housing 152. The mounting plate 151 includes a slot 156 to accommodate the guide post 154 and the cover plate 155. The guide post 154 is movable disposed in the guide housing 152. A spring 157 is disposed inside the spring housing 153 and biases the guide post 154 against the spring housing 153, guide housing 152, and the mounting plate 151. The cover plate 155 is pivotally coupled to the guide post 154. In FIG. 5A, the cover plate 155 is biased downwardly relative to the guide post 154. During use, as the plug body 110 is moved toward the receptacle body 210, the front end of the guide post 154 will abut the receptacle body 210. The mounting plate 151 and the guide housing 152 will move relative to the guide post 154, thereby compressing the spring 157. The slot 156 of the mounting plate 151 will pivot the cover plate 155 upward toward the guide post 154. Continue movement of the plug body 110 will cause the cover plate 155 to slide inside the slot 156, thereby opening the electrical plugs 141, 142 for connection.

Figure 6A:
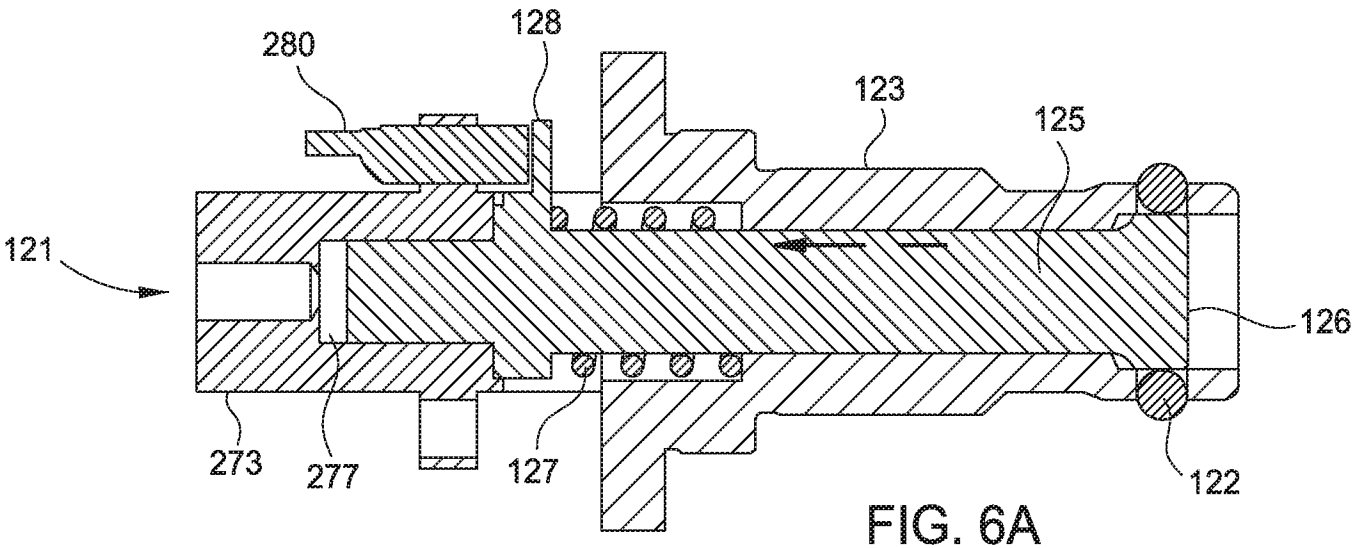
FIGS. 6A-6D are schematic cross-sectional views of an operational sequence of an exemplary embodiment of a locking device.

In one embodiment, one or more locking devices 121, 221 are used to lock the first portion 100 to the second portion 200, after engagement. An exemplary locking device 121, 221 is shown in FIGS. 6A-6D, which are schematic cross-sectional views of an operational sequence of an exemplary embodiment of a locking device. The locking device includes a cylinder assembly 121 having a plurality dogs 122 for connection with a bushing 221. FIG. 6A is a cross-sectional view of the cylinder assembly 121, which is attached to and moveable with the plug body 110. FIG. 6E is a cross-sectional view of the bushing 221, which is attached to the receptacle body 210 and configured to receive the dogs 122 of the cylinder assembly 121. Referring to FIG. 6A, the cylinder assembly 121 includes a housing 123 having a bore therethrough and a plurality of apertures for retaining a plurality of dogs 122. The housing 123 is attached to the plug body 110 and extends toward the second portion 200. A mandrel 125 is disposed inside the bore and is configured to activate the dogs 122. The mandrel 125 has a head portion 126 having an enlarged diameter. A lower end of the mandrel 125 is disposed in a bore 277 of a cylinder housing 273. Fluid may be supplied into the bore 277 to move the piston 275. The mandrel 125 includes a base 128 to act as a stop mechanism. A spring 127 is provided to bias the mandrel 125 toward a retracted position. One or more sensors 280 are used to determine the status of the locking device. An exemplary sensor 280 is an inductive sensor. The sensor 280 may be configured to detect a shoulder of the base 128.

FIGS. 6A-6D are schematic illustrations of an exemplary operational sequence of the locking devices 121, 221. FIG. 6A illustrates the mandrel 125 in the retracted position. The spring 127 has retracted the mandrel 125 and the pressure in the bore 277 is insufficient to overcome the biasing force of the spring 127. The enlarged end 126 of the mandrel 125 has pushed the dogs 122 outwardly in the apertures. The sensor 280 will send a signal indicating the locking device 121 is in a locked position.

Figure 6B:
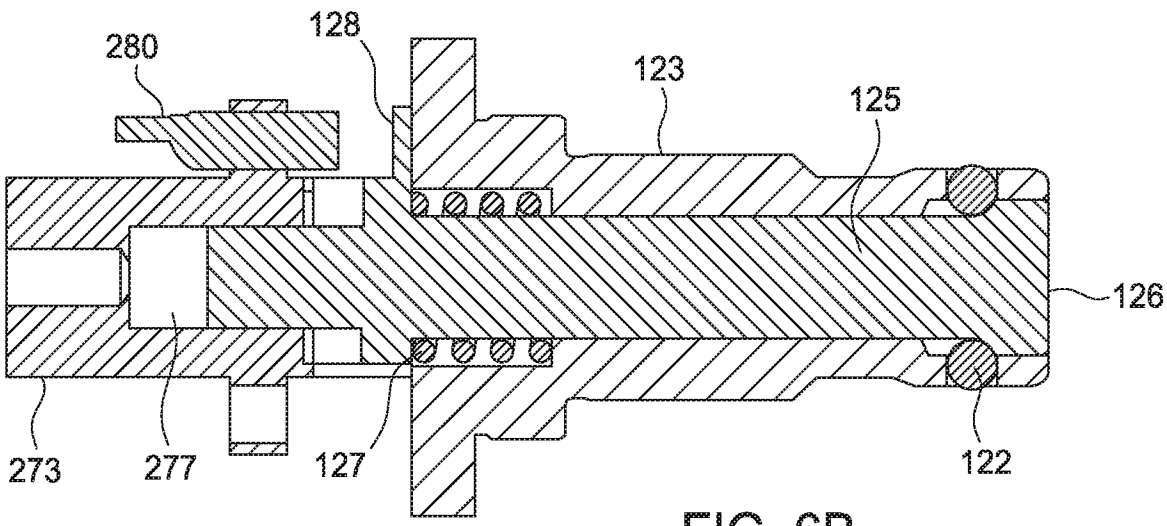

In FIG. 6B, sufficient pressure is supplied to the bore 277 to overcome the spring 127, thereby extending the mandrel 125. The enlarged end 126 of the mandrel 125 has moved away from the dogs 122 to allow the dogs to move inwardly in the apertures. The sensor 280 will send a signal indicating the locking device 121 is in an unlocked position.

Figure 6C:
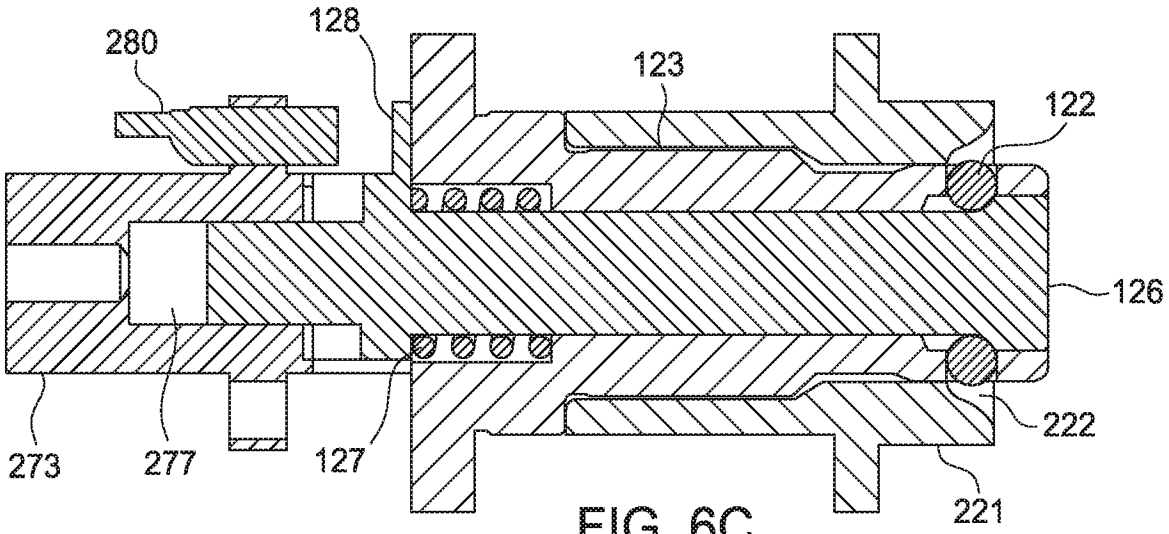

In FIG. 6C, the locking device 121 is inserted into the bushing 221. The dogs 122 are positioned adjacent the recess 222 of the bushing 221. After inserting the locking device 121, the pressure in the bore 277 is relieved until it is below the biasing force of the spring 127.

Figure 6D:
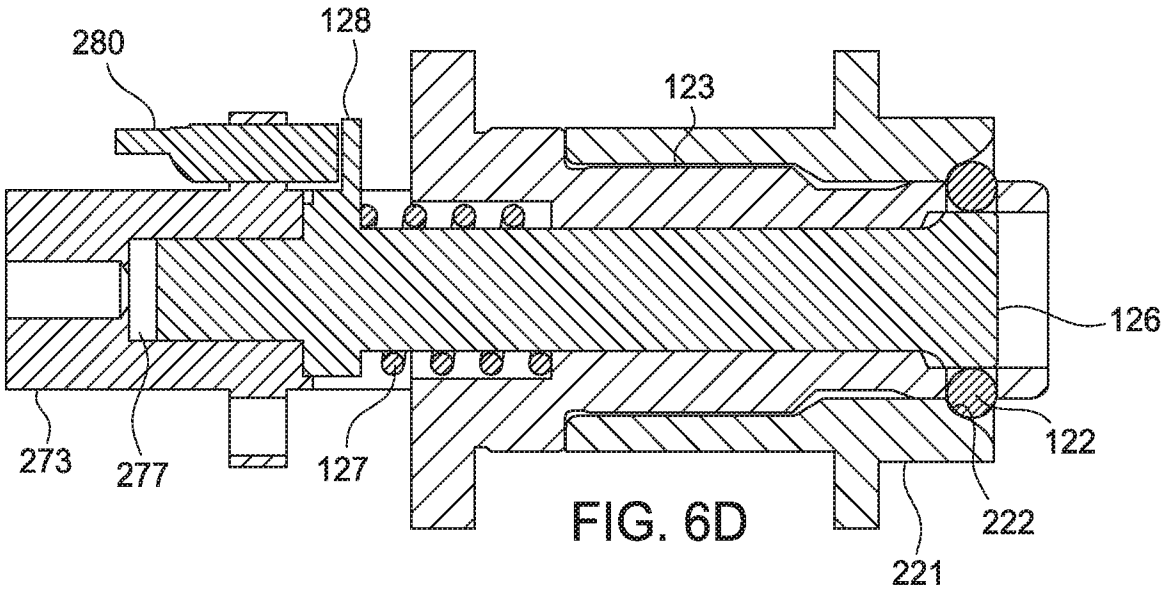
Figure 6E:
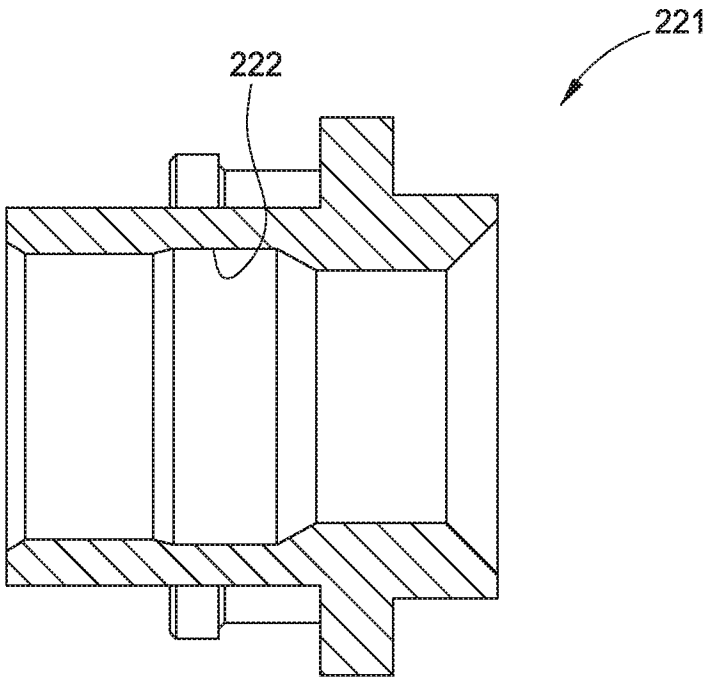
FIG. 6E is a cross-sectional view of an exemplary embodiment of a bushing.

In FIG. 6D, the spring 127 has retracted the mandrel 125. The enlarged end 126 of the mandrel 125 has pushed the dogs 122 outwardly to engage the recess 222 of the bushing 221. The sensor 280 will send a signal indicating the locking device 121 is in a locked position.

In operation, the coupling mechanism 30 may be used to provide fluid, electric power, and data communication between a first tool, such as a tong 20, and a second tool, such as a positioning tool 10. In one example, the coupling mechanism 30 is certified for use in a work area designated as zone 1 of ATEX or IECEx, which are standards relating to equipments for use in explosive atmosphers. In one embodiment, the first portion 100 is attached to the positioning tool 10, and the second portion 200 is attached to the tong 20. It must be noted that the second portion 200 may be attached to the positioning tool 10 and the first portion 100 may be attached to the tong 20. The positioning tool 10 is operated to engage the tong 20 so that the tong 20 can be moved by the positioning tool 10. When the positioning tool 10 is positioned to engage the tong 20, the first portion 100 of the coupling mechanism 30 is also aligned for engagement with the second portion 200, as shown in FIG. 7A.

Figure 7A:
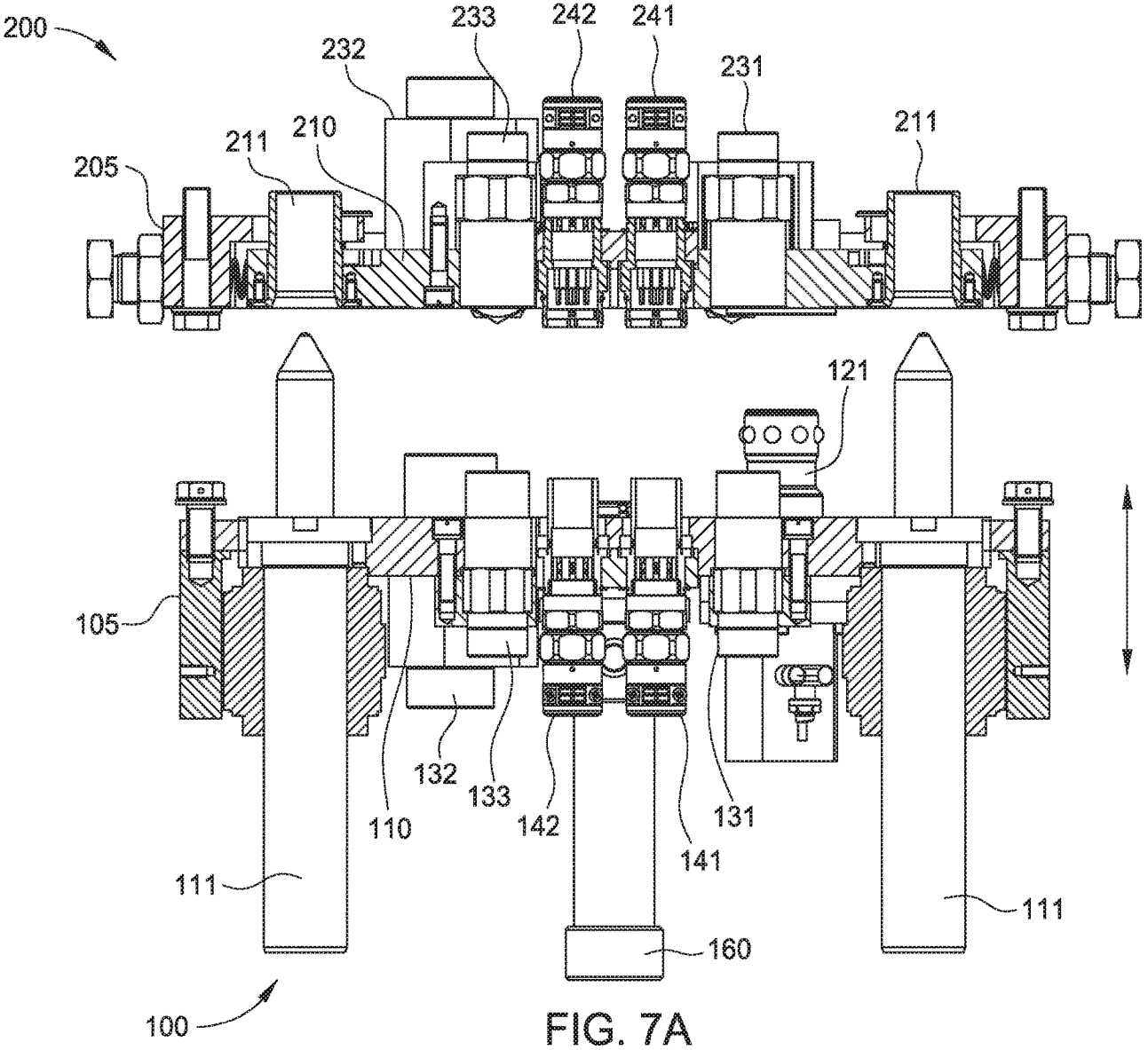
FIGS. 7A-7C illustrate a schematic sequence for engaging the first portion to the second portion.
Figure 7B:
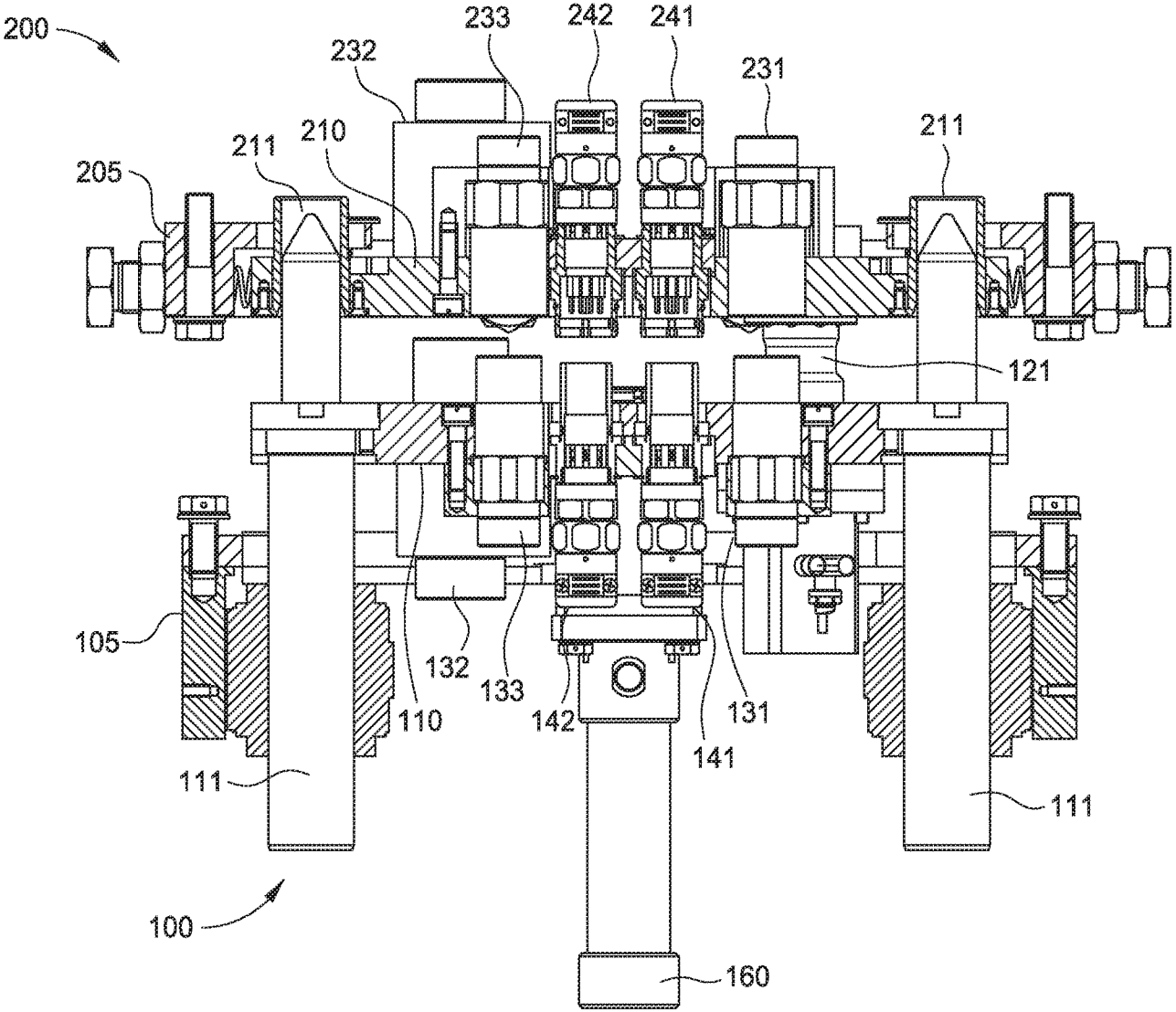
Figure 7C:
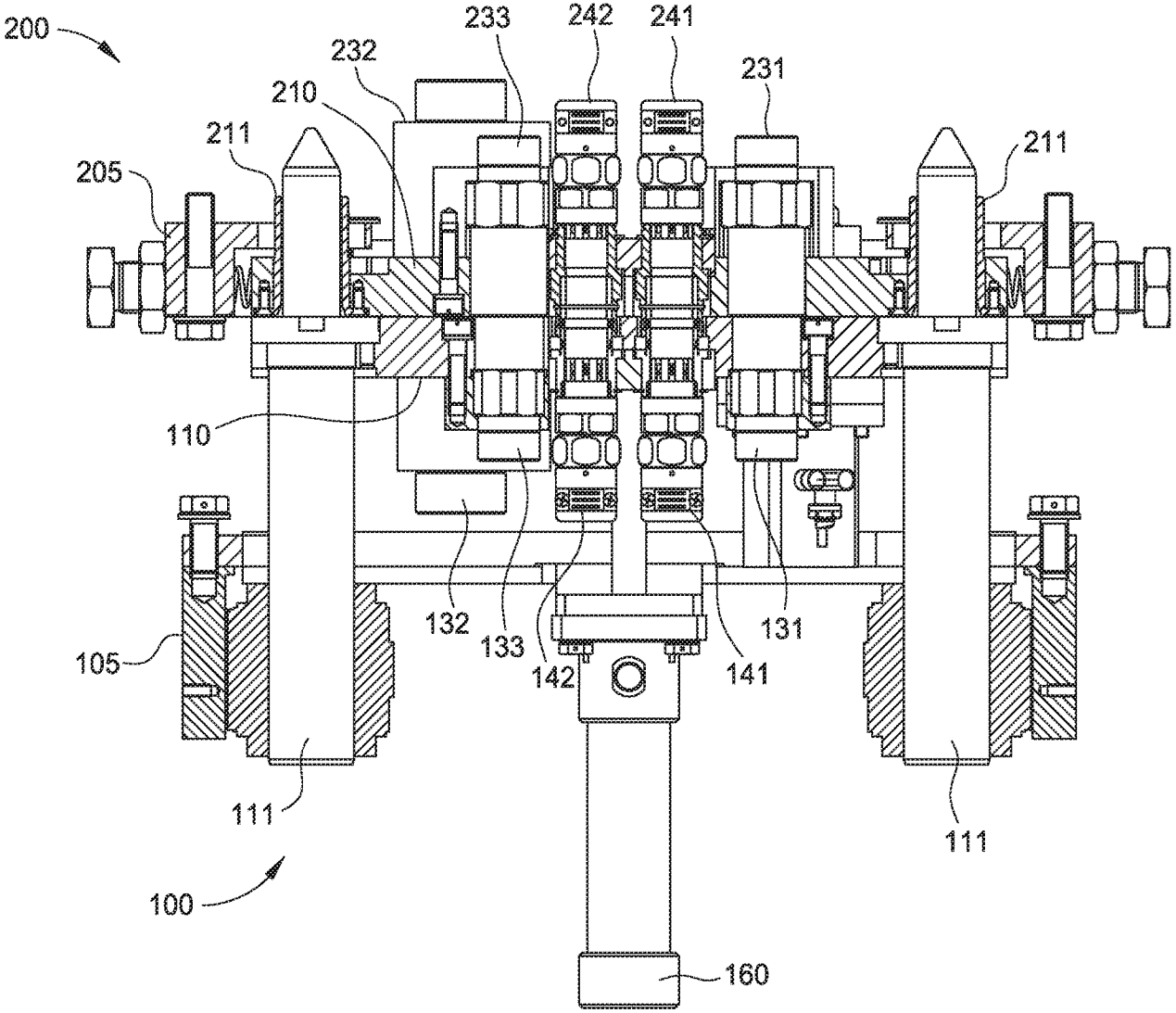
Figure 7D:
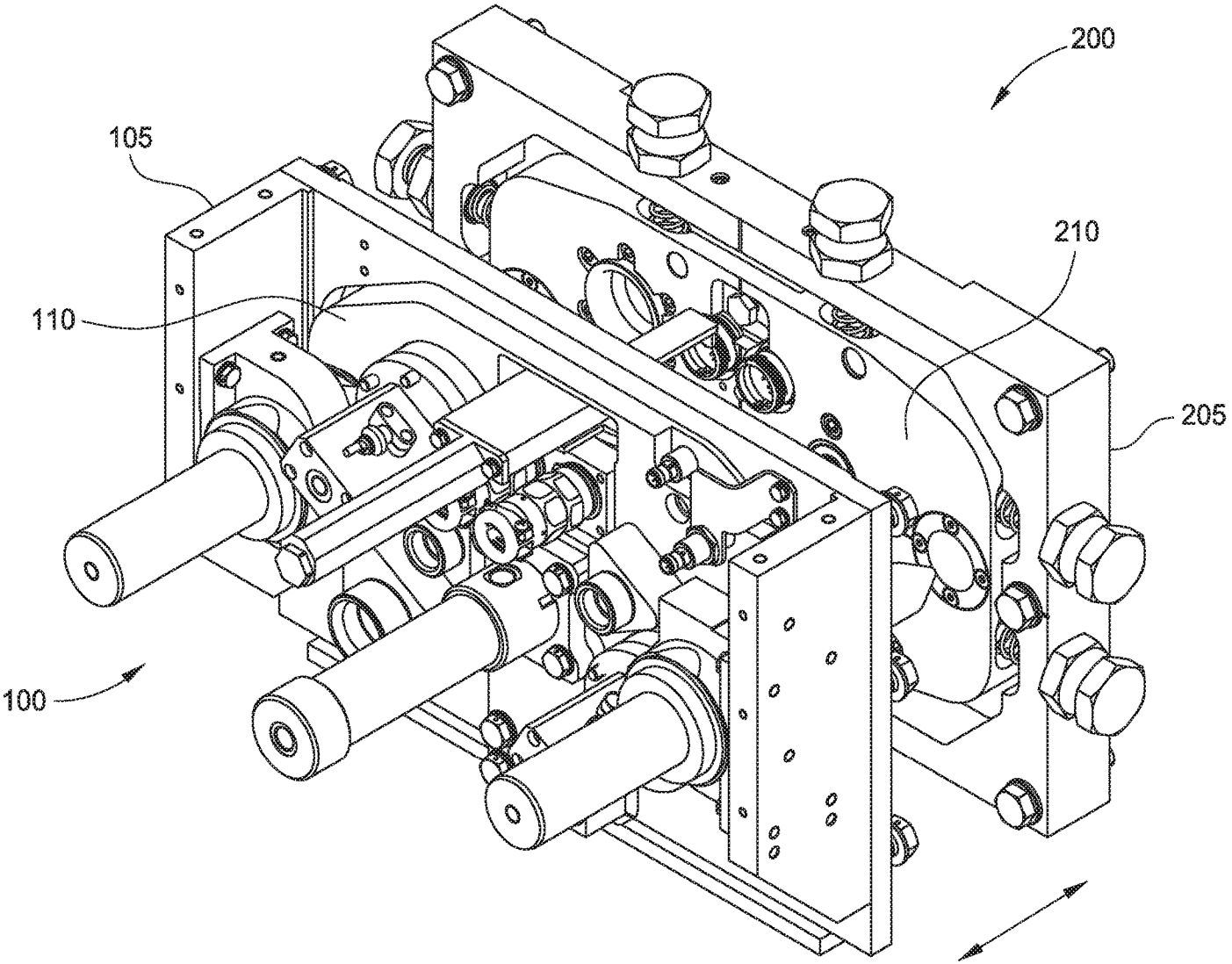
FIGS. 7D-7F are perspective views of the first portion relative to the second portion of FIGS. 7A-7C, respectively.
Figure 7E:
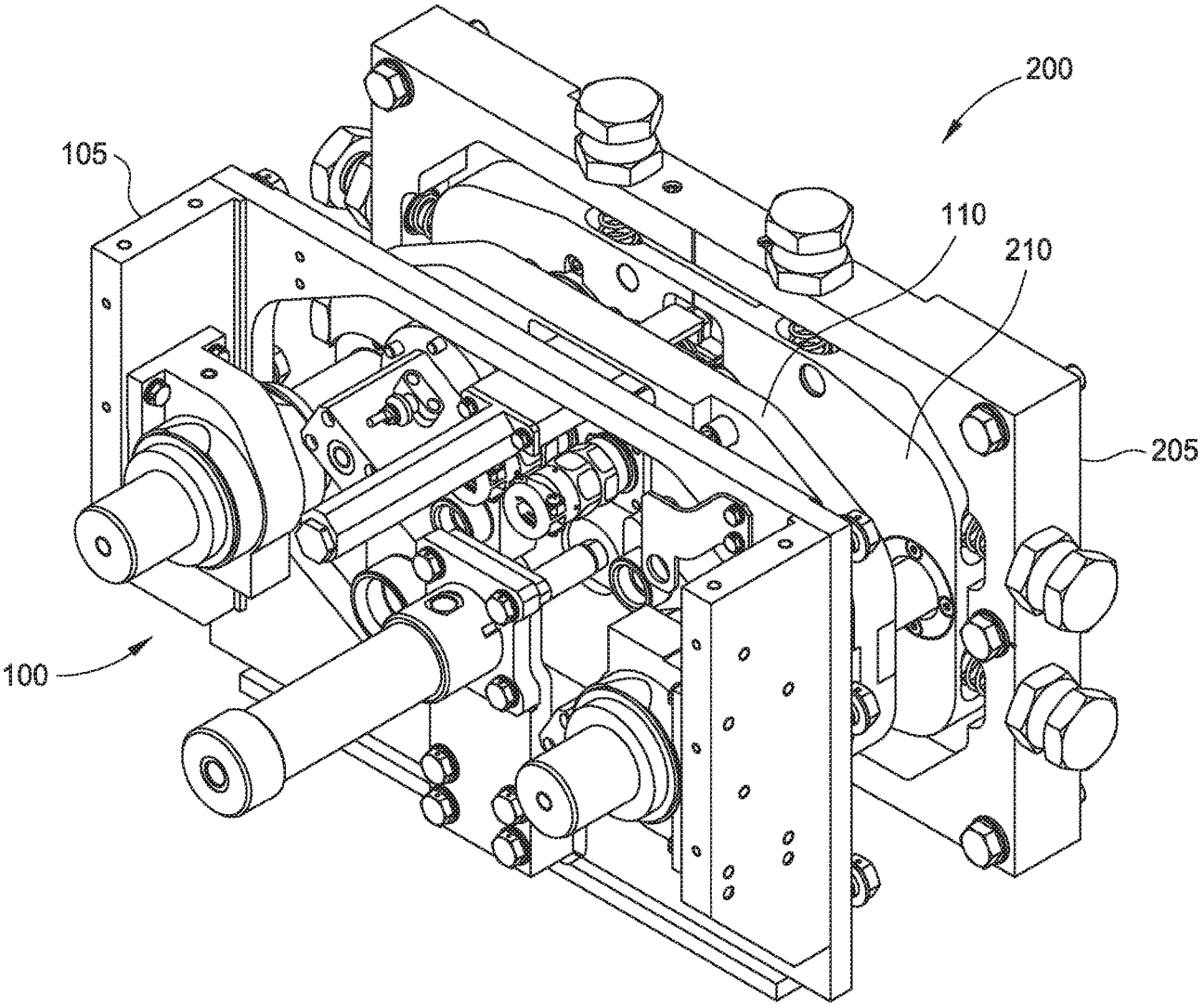
Figure 7F:
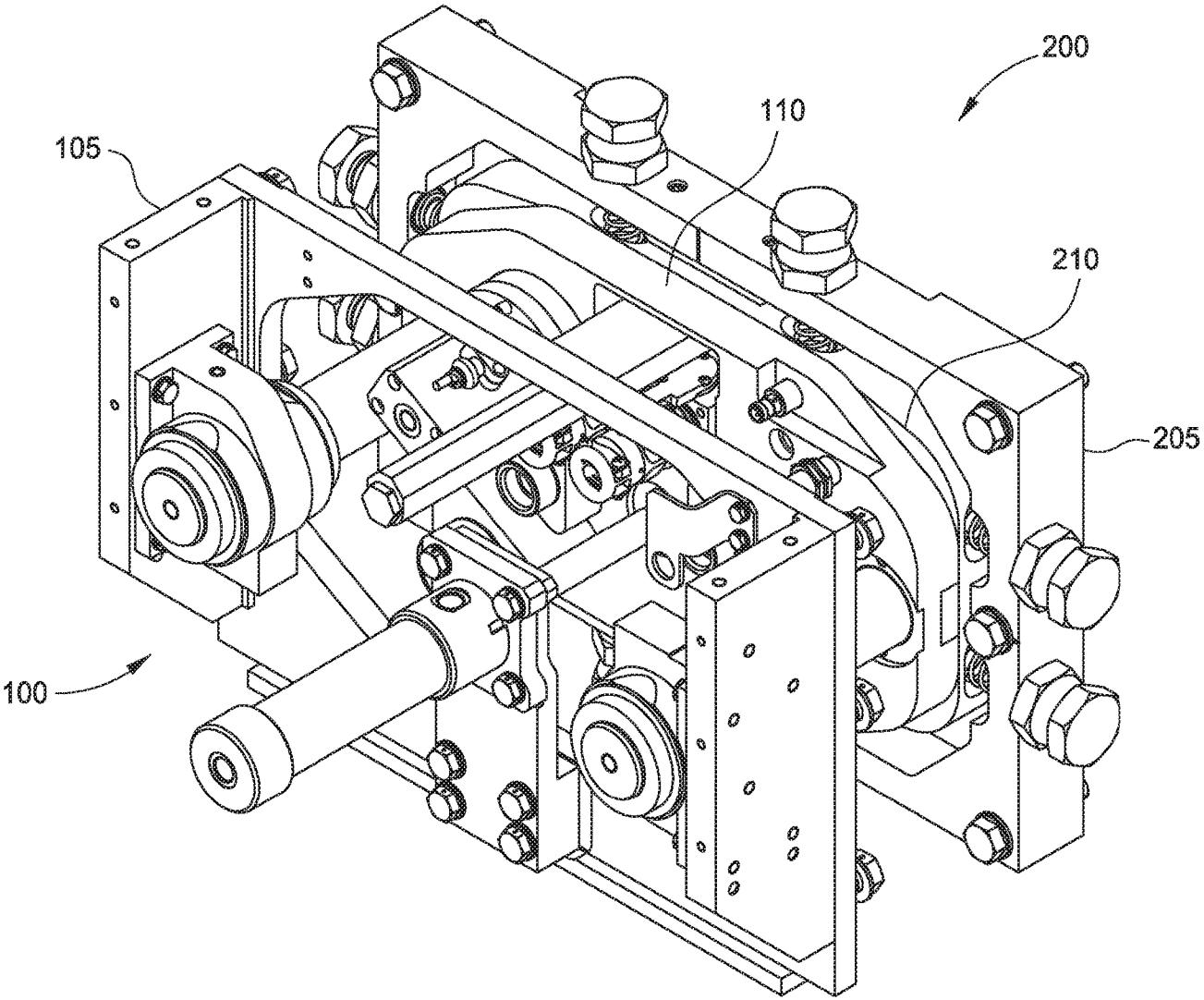

FIGS. 7A-7C illustrate a schematic sequence for engaging the first portion 100 to the second portion 200. FIGS. 7D-7F are perspective views of the first portion 100 relative to the second portion 200 of FIGS. 7A-7C, respectively. In one example, first portion 100 is configured for automatic connection with the second portion 200. FIG. 7A shows the first portion 100 in position to begin engagement with the second portion 200. To begin engagement, the cylinder 160 is actuated to extend the piston, thereby moving the plug body 110 toward the receptacle body 210. Movement of the plug body 110 extends the guiding elements 111 from the frame 105 and moves the guiding elements toward the receptacle body 210. The hydraulic plugs 131, 132 and the electrical plugs 141, 142 also move with the plug body 110. For sake of clarity, some of the components on the plug body 110, such as the locking devices 121, the protection tool 150, and additional plugs are not shown.

FIG. 7B shows the guiding elements 111 in contact with the receiving hole 211 of the receptacle body 210. The guiding elements 111 extend out of the plug body 110 a sufficient length such that they engage the receptacle body 210 before the hydraulic plugs 131, 132, 133 and the electrical plugs 141, 142. The guiding elements 111 helps to ensure the hydraulic plugs and the electrical plug are aligned with their respective receptacles for engagement. If a protection tool 150 is used, movement of the plug body 110 would cause the guide post 154 to abut the receptacle body 210. The mounting plate 151 will then move relative to the guide post 154 and the cover plate 155. The slot 156 will pivot the cover plate 155 and eventually slide over the cover plate 155 and the guide post 154, thereby exposing the electrical plugs 141, 142 for engagement.

As shown in FIG. 7C, further actuation of the hydraulic cylinder 160 causes the hydraulic plugs 131, 132, 133 and the electrical plugs 141, 142 to engage their respective receptacles. In particular, the hydraulic plugs 131, 132, 133 will engage hydraulic receptacles 231, 232, 233, respectively, to provide communication for supplying hydraulic fluid, returning hydraulic fluid, and draining hydraulic fluid. The electrical plugs 141, 142 will engage the electrical receptacles 241, 242 respectively, to provide electrical power communication and data communication. The electrical plugs 141, 142 are configured to retain a spark, if any, between the plugs 141, 142 and the receptacle 241, 242 during the connection process. If a locking device is used, the cylinder 123 will be inserted into the bushing 221. The mandrel 126 is retracted to urge the dogs 122 to the outward position in the housing 123 to engage the recess 222 of the bushing 221, thereby locking the plug body 110 to the receptacle body 211.

In one embodiment, a coupling mechanism for coupling a first downhole tool to a second downhole tool includes a first portion, a second portion, and a locking device for locking the first portion to the second portion. The first portion includes a frame; a plug body movable relative to the frame; a guiding element coupled to the plug body; at least one of a hydraulic plug and an electric plug; and an actuator for moving the plug body relative to the frame. The second portion includes a receptacle body; a guide receptacle for receiving the guiding element; a respective receptacle for receiving at least one of the hydraulic plug; and the electric plug.

In one or more of the embodiments described herein, the locking device includes a cylinder having a dog, the cylinder coupled to the plug body; and a bushing for receiving the cylinder, the bushing coupled to the receptacle body.

In one or more of the embodiments described herein, the locking device further includes a mandrel to actuating the dog.

In one or more of the embodiments described herein, the coupling mechanism includes a protection tool for the electric plug.

In one or more of the embodiments described herein, the protection tool includes a pivotable cover plate.

In one or more of the embodiments described herein, the actuator includes a hydraulic cylinder.

In one or more of the embodiments described herein, the guiding element is movable relative to the frame and movable with the plug body.

In one or more of the embodiments described herein, the guiding element contacts the guide receptacle before the at least one of the hydraulic plug and the electric plug contacts the respective receptacle.

In one or more of the embodiments described herein, the electric plug and the respective receptacle are configured to retain a spark between the electric plug and the respective receptacle during connection.

In one or more of the embodiments described herein, coupling of the first portion to the second portion is automatic.

In one or more of the embodiments described herein, coupling of the first portion to the second portion occurs in a hazardous area.

In another embodiment, a method of coupling a first downhole tool to a second downhole tool includes extending a plug body of the first downhole tool toward a receptacle body of the second downhole tool; connecting a guiding element to a guide receptacle; connecting an electric plug to an electric receptacle; and actuating a locking device to lock the plug body to the receptacle.

In one or more of the embodiments described herein, extending the plug body includes activating an actuator to move the plug body.

In one or more of the embodiments described herein, the method includes connecting a hydraulic plug to a hydraulic receptacle.

In one or more of the embodiments described herein, the method includes retaining a spark between the electric plug and the electric receptacle.

In one or more of the embodiments described herein, actuating a locking device includes engaging a dog of the plug body to a recess of the receptacle body.

In one or more of the embodiments described herein, the method includes covering the electric plug prior to connecting the electric plug to the electric receptacle.

In one or more of the embodiments described herein, the method includes exposing the electric plug by retracting a cover plate relative to the plug body.

In one or more of the embodiments described herein, connecting an electric plug to an electric receptacle is performed automatically.

While the foregoing is directed to embodiments of the present disclosure, other and further embodiments of the disclosure may be devised without departing from the basic scope thereof, and the scope thereof is determined by the claims that follow.

The invention claimed is:

1. A coupling mechanism for coupling a positioning tool to a wellbore tong at the surface of a well, comprising:

a first portion associated with the positioning tool having:

a frame;

a plug body movable relative to the frame;

a guiding element coupled to the plug body;

at least one of a hydraulic plug and an electric plug; and an actuator for moving the plug body relative to the frame; and a second portion associated with the tong having:

a receptacle body;

a guide receptacle for receiving the guiding element;

a respective receptacle for receiving at least one of the hydraulic plug and the electric plug;

a protection tool for the electric plug; and a locking device for locking the first portion to the second portion.

2. The coupling mechanism of claim 1, wherein the locking device includes:

a cylinder having a dog, the cylinder coupled to the plug body; and a bushing for receiving the cylinder, the bushing coupled to the receptacle body.

3. The coupling mechanism of claim 2, wherein the locking device further comprises a mandrel for actuating the dog.

4. The coupling mechanism of claim 1, wherein the protection tool includes a pivotable cover plate.

5. The coupling mechanism of claim 1, wherein the actuator comprises a hydraulic cylinder.

6. The coupling mechanism of claim 1, wherein the guiding element is movable relative to the frame and movable with the plug body.

7. The coupling mechanism of claim 1, wherein the guiding element contacts the guide receptacle before the at least one of the hydraulic plug and the electric plug contacts the respective receptacle.

8. The coupling mechanism of claim 1, wherein the electric plug and the respective receptacle are configured to retain a spark between the electric plug and the respective receptacle during connection.

9. The coupling mechanism of claim 1, wherein coupling of the first portion to the second portion is automatic.

10. The coupling mechanism of claim 1, wherein coupling of the first portion to the second portion occurs in a hazardous area.

11. A method of coupling a positioning tool to a wellbore tong, comprising:

extending a plug body of the positioning tool toward a receptacle body of the wellbore tong;

connecting a guiding element to a guide receptacle;

connecting an electric plug to an electric receptacle, wherein the electric plug is covered prior to connecting the electric plug to the electric receptacle; and actuating a locking device to lock the plug body to the receptacle.

12. The method of claim 11, wherein extending the plug body comprises activating an actuator to move the plug body.

13. The method of claim 11, further comprising connecting a hydraulic plug to a hydraulic receptacle.

14. The method of claim 11, further comprising retaining a spark between the electric plug and the electric receptacle.

15. The method of claim 11, wherein the actuating a locking device comprises engaging a dog of the plug body to a recess of the receptacle body.

16. The method of claim 11, further comprising exposing the electric plug by retracting a cover plate relative to the plug body.

17. The method of claim 11, wherein connecting an electric plug to an electric receptacle is performed automatically.

18. A coupling mechanism for coupling a positioning tool to a wellbore tong at the surface of a well, comprising:

a first portion associated with the positioning tool having:

a first frame having a first window;

a plug body at least partially disposed in the first window and movable out of the first window relative to the first frame;

a guiding element coupled to the plug body;

at least one of a hydraulic plug and an electric plug; and an actuator for moving the plug body relative to the first frame; and a second portion associated with the tong having:

a receptacle body;

a guide receptacle for receiving the guiding element;

a respective receptacle for receiving at least one of the hydraulic plug and the electric plug; and a locking device for locking the first portion to the second portion.

19. The coupling mechanism of claim 18, wherein receptacle body is disposed in a second frame of the second portion.

20. The coupling mechanism of claim 19, further comprising a spring coupling the receptacle body to the second frame.

* * * * *